US011180935B2

(12) United States Patent
Takagi et al.

(10) Patent No.: US 11,180,935 B2
(45) Date of Patent: Nov. 23, 2021

(54) VEHICLE DOOR LOCK APPARATUS

(71) Applicant: ANSEI CORPORATION, Obu (JP)

(72) Inventors: Masaharu Takagi, Nagoya (JP); Satoshi Yamaji, Nagoya (JP)

(73) Assignee: ANSEI CORPORATION, Obu (JP)

( * ) Notice: Subject to any disclaimer, the term of this patent is extended or adjusted under 35 U.S.C. 154(b) by 1164 days.

(21) Appl. No.: 15/456,770

(22) Filed: Mar. 13, 2017

(65) Prior Publication Data

US 2018/0016820 A1 Jan. 18, 2018

(30) Foreign Application Priority Data

Jul. 15, 2016 (JP) ..... JP2016-140590
Jul. 15, 2016 (JP) ..... JP2016-140598

(51) Int. Cl.

| | |
|---|---|
| ***E05B 15/16*** | (2006.01) |
| ***E05B 81/06*** | (2014.01) |
| ***E05B 85/02*** | (2014.01) |
| *E05B 79/02* | (2014.01) |
| *E05B 81/16* | (2014.01) |

(Continued)

(52) U.S. Cl.

CPC ..... *E05B 81/06* (2013.01); *E05B 15/16* (2013.01); *E05B 85/02* (2013.01); *E05B 77/06* (2013.01); *E05B 79/02* (2013.01); *E05B 81/16* (2013.01); *E05B 81/72* (2013.01)

(58) Field of Classification Search

CPC ..... E05B 81/06; E05B 15/16; E05B 85/02; E05B 79/02; E05B 81/16; E05B 77/06; E05B 81/72

See application file for complete search history.

(56) References Cited

U.S. PATENT DOCUMENTS

| | | | |
|---|---|---|---|
| 2,634,147 | A | 4/1953 | Robertson |
| 2,806,727 | A | 9/1957 | Johnstone |
| 2,934,930 | A | 5/1960 | Garvey |

(Continued)

FOREIGN PATENT DOCUMENTS

| | | | |
|---|---|---|---|
| CN | 1174882 | C | 11/2004 |
| CN | 1729341 | A | 2/2006 |

(Continued)

OTHER PUBLICATIONS

Office Action and Search Report from the Taiwanese Patent Office dated Jul. 30, 2020 in related application No. 106131946, and translation thereof.

(Continued)

*Primary Examiner* — Kristina R Fulton
*Assistant Examiner* — Thomas L Neubauer
(74) *Attorney, Agent, or Firm* — J-Tek Law PLLC; Jeffrey D. Tekanic; Mark A. Ussai

(57) ABSTRACT

A vehicle door lock apparatus (1) includes a latch housing (9), a latch mechanism (8), an actuating housing (7), and an actuating mechanism (6). The actuating housing (7) includes a first housing (70) made of resin joined to a second housing (80) made of resin, thereby forming a housing chamber (7A). The first housing (70) includes at least one projection (75P, 75Q, 75R, and 75S) that extends toward the second housing (80) from a proximal end (75A) to a distal end (75B). The second housing 80 includes at least one receptacle (85P, 85Q, 85R, and 85S) having a contact part (85A) welded to the distal end (75B).

20 Claims, 15 Drawing Sheets

(51) Int. Cl.
*E05B 77/06* (2014.01)
*E05B 81/72* (2014.01)

(56) References Cited

U.S. PATENT DOCUMENTS 2,977,785 A 4/1961 Beckman
2,996,327 A 8/1961 France et al.
3,334,934 A 8/1967 Bela
3,359,767 A 12/1967 Alfonsas et al.
3,400,962 A 9/1968 Martens
3,596,482 A 8/1971 Pollak
3,848,909 A 11/1974 Foley
4,382,622 A 5/1983 Ishikawa
4,440,006 A 4/1984 Kleefeldt
4,538,845 A * 9/1985 Yamada ..... E05B 85/02 292/216
4,775,176 A * 10/1988 Ikeda ..... E05B 85/243 292/216
4,783,102 A 11/1988 Bernard
4,948,184 A 8/1990 Weyerstall et al.
5,350,206 A 9/1994 Akahori et al.
5,603,539 A 2/1997 Gruhn et al.
5,733,046 A 3/1998 Bellmore et al.
5,802,894 A 9/1998 Jahrsetz et al.
6,178,845 B1 1/2001 Gutschner
6,264,253 B1 7/2001 Takaishi
6,416,088 B1 7/2002 Graute
6,419,286 B1 7/2002 Szablewski
6,601,885 B1 8/2003 Yiu
6,971,816 B2 12/2005 Miyagawa et al.
7,455,336 B2 * 11/2008 Baumchen ..... B60N 2/01541 292/216
7,478,846 B2 1/2009 Yoshikuwa et al.
7,568,741 B2 8/2009 Odahara
7,621,571 B2 11/2009 Umino
7,762,594 B2 7/2010 Arabia, Jr. et al.
7,827,836 B2 11/2010 Cetnar
7,927,535 B2 * 4/2011 Cetnar ..... E05B 85/02 264/255
8,240,723 B2 8/2012 Akahori et al.
8,376,417 B2 2/2013 Machida et al.
8,438,888 B2 5/2013 Akizuki et al.
8,662,545 B2 * 3/2014 Taga ..... E05B 85/02 292/216
8,678,452 B2 3/2014 Nagaoka et al.
8,726,705 B2 5/2014 Tabe et al.
8,789,861 B2 7/2014 Takayanagi et al.
8,814,228 B2 8/2014 Fujiwara et al.
8,827,328 B2 9/2014 Akizuki et al.
9,027,435 B2 5/2015 Ohba et al.
9,631,404 B2 4/2017 Takagi et al.
9,708,837 B2 7/2017 Bendel et al.
10,047,548 B2 8/2018 Zeabari
10,094,149 B2 10/2018 Mittelbach
10,151,124 B2 12/2018 Faitl et al.
10,196,838 B2 2/2019 Nagaoka et al.
10,267,069 B2 4/2019 Zhang
10,273,724 B2 4/2019 Yamagata et al.
10,526,823 B2 1/2020 Nagata et al.
10,597,908 B2 3/2020 Taga
2001/0015558 A1 8/2001 Fisher et al.
2003/0107235 A1 6/2003 Komatsu et al.
2003/0218340 A1 11/2003 Coleman et al.
2004/0178659 A1 9/2004 Komatsu et al.
2004/0227357 A1 11/2004 Ishihara et al.
2004/0251712 A1 12/2004 Obara
2005/0140149 A1 6/2005 Umino
2005/0218661 A1 10/2005 Brose et al.
2006/0006671 A1 1/2006 Noel et al.
2006/0028029 A1 2/2006 Spurr
2006/0048598 A1 3/2006 Roussel et al.
2006/0087129 A1 4/2006 Gotou et al.
2006/0157989 A1 7/2006 Graute
2006/0214467 A1 9/2006 Usuzaki et al.
2008/0078215 A1 4/2008 Odahara
2008/0203737 A1 8/2008 Tomaszewski et al.
2010/0084888 A1 4/2010 Ishitobi et al.
2010/0109350 A1 5/2010 Gschweng et al.
2010/0194120 A1 8/2010 Kaiser et al.
2010/0207401 A1 8/2010 Taga
2010/0327609 A1 12/2010 Akizuki et al.
2011/0072870 A1 * 3/2011 Downes ..... A45C 11/328 70/456 R
2011/0179835 A1 7/2011 Tabe et al.
2012/0000258 A1 1/2012 Akizuki et al.
2012/0056437 A1 3/2012 Takayanagi et al.
2012/0068479 A1 3/2012 Bendel et al.
2012/0118029 A1 5/2012 Akizuki et al.
2013/0015673 A1 * 1/2013 Akizuki ..... E05B 77/34 292/307 R
2013/0049379 A1 2/2013 Yokota et al.
2013/0328325 A1 12/2013 Uehara et al.
2014/0346786 A1 11/2014 Takagi et al.
2014/0361555 A1 12/2014 Bendel et al.
2015/0048632 A1 2/2015 Menke
2015/0191945 A1 7/2015 Yamaguchi et al.
2015/0247347 A1 9/2015 Suzumura et al.
2015/0259952 A1 9/2015 Barmscheidt
2015/0267441 A1 9/2015 Fuchs et al.
2015/0361694 A1 12/2015 Zeabari
2016/0017645 A1 1/2016 Tomaszewski et al.
2016/0115718 A1 4/2016 Lee et al.
2016/0177599 A1 6/2016 Nozawa et al.
2016/0208523 A1 * 7/2016 Bingle ..... E05B 85/10
2016/0273248 A1 9/2016 Mittelbach
2016/0281395 A1 9/2016 Scholz et al.
2016/0312498 A1 10/2016 Jidaisho
2017/0122355 A1 5/2017 Estrada et al.
2017/0138096 A1 5/2017 Zhang
2017/0159334 A1 * 6/2017 Ishiguro ..... E05B 85/26
2017/0204639 A1 7/2017 Akahori et al.
2017/0234039 A1 * 8/2017 Taga ..... E05B 79/04 292/337
2018/0023325 A1 1/2018 Takagi et al.
2018/0023327 A1 1/2018 Takagi et al.
2018/0073282 A1 3/2018 Takagi et al.
2018/0080262 A1 3/2018 Takagi et al.
2018/0148956 A1 5/2018 Takagi et al.

FOREIGN PATENT DOCUMENTS

CN 101748944 A 6/2010
CN 101812947 A 8/2010
CN 101812948 A 8/2010
CN 102362041 A 2/2012
CN 101641231 B 11/2012
CN 102822434 A 12/2012
CN 103195310 A 7/2013
CN 203239056 U 10/2013
CN 103403283 A 11/2013
CN 203294205 U 11/2013
CN 103597155 A 2/2014
CN 104114792 A 10/2014
CN 203961528 U 11/2014
CN 105525808 A 4/2016
CN 105545126 A 5/2016
CN 105593445 A 5/2016
CN 106065748 A 11/2016
DE 102008015627 A1 10/2009
DE 102015223514 A1 6/2016
EP 0894923 A1 2/1999
EP 2881529 A1 6/2015
EP 2754799 B1 3/2017
GB 2396656 A 6/2004
GB 2477612 A 8/2011
JP S5944477 A 3/1984
JP H0617960 Y2 5/1994
JP 2528945 Y2 3/1997
JP 2002-129806 A 5/2002
JP 4163490 A 6/2004
JP 2004156330 A 6/2004
JP 2005188130 A 7/2005
JP 2008088708 A 4/2008
JP 2011026826 A 2/2011

(56) References Cited

FOREIGN PATENT DOCUMENTS

| | | | |
|---|---|---|---|
| JP | 2011153431 | A | 8/2011 |
| JP | 2011226194 | A | 11/2011 |
| JP | 2012-180702 | A | 9/2012 |
| JP | 5030908 | B2 | 9/2012 |
| JP | 2013036242 | A | 2/2013 |
| JP | 2013096144 | A | 5/2013 |
| JP | 2013117115 | A | 6/2013 |
| JP | 2014-15717 | A | 1/2014 |
| JP | 2014029094 | A | 2/2014 |
| JP | 2014043769 | A | 3/2014 |
| JP | 5509377 | B1 | 6/2014 |
| JP | 2015034423 | A | 2/2015 |
| JP | 2015096683 | A | 5/2015 |
| JP | 2015190306 | A | 11/2015 |
| JP | 2015209641 | A | 11/2015 |
| JP | 2016037700 | A | 3/2016 |
| JP | 2016056550 | A | 4/2016 |
| JP | 2016098589 | A | 5/2016 |
| JP | 5930273 | B2 | 6/2016 |
| JP | 2018012940 | A | 1/2018 |
| JP | 2018031256 | A | 3/2018 |
| JP | 2018141361 | A | 9/2018 |
| KR | 100694448 | B1 | 3/2007 |
| TW | 593005 | B | 6/2004 |
| WO | 2016002101 | A1 | 1/2016 |
| WO | 2016021084 | A1 | 2/2016 |
| WO | 2016038754 | A1 | 3/2016 |

OTHER PUBLICATIONS

Office Action and Search Report from the Chinese Patent Office dated Apr. 14, 2020 in related Chinese application No. 201710578654.6, and machine translation thereof.

Office Action from the Japanese Patent Office dated Nov. 5, 2019 in counterpart Japanese application No. 2016-140590, and machine translation thereof.

Office Action from the Japanese Patent Office dispatched Nov. 5, 2019 in related Japanese application No. 2016-183897, and machine translation thereof.

Machine translation of Search Report from the Japanese Patent Office dated Feb. 18, 2020 in related Japanese application No. 2016-223076.

Office Action from the Japanese Patent Office dated Feb. 25, 2020 in related Japanese application No. 2016-223076, and machine translation thereof.

Unpublished U.S. Appl. No. 15/698,888.

Unpublished U.S. Appl. No. 15/653,645.

Unpublished U.S. Appl. No. 15/653,700.

Unpublished U.S. Appl. No. 16/296,717.

Office Action from the Chinese Patent Office dated Apr. 9, 2020 in related Chinese application No. 201710115391, and machine translation thereof.

Search Report from the Chinese Patent Office dated Mar. 26, 2020 in related Chinese application No. 201710115391.

Office Action and a Search Report dated Oct. 7, 2020 in related Taiwanese application No. 106108915, and English translation of the Office Action.

* cited by examiner

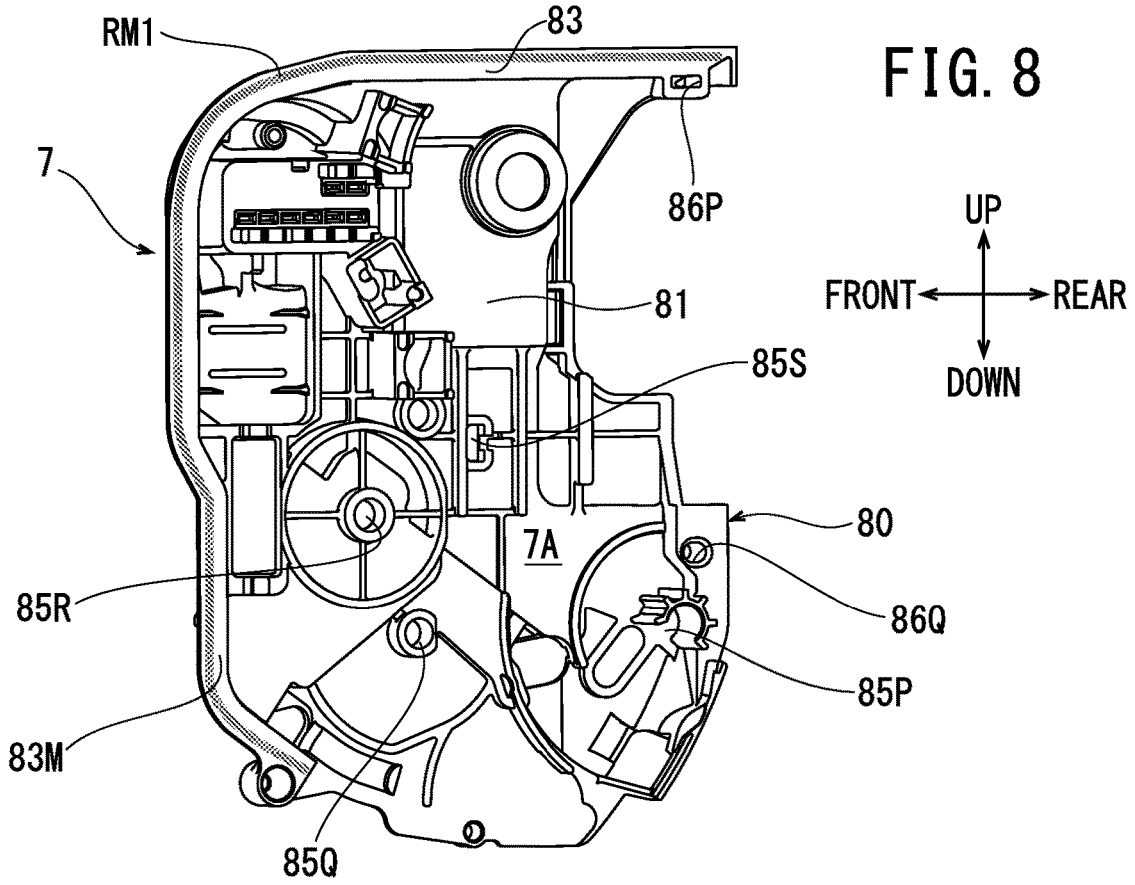
FIG. 8
FIG. 9
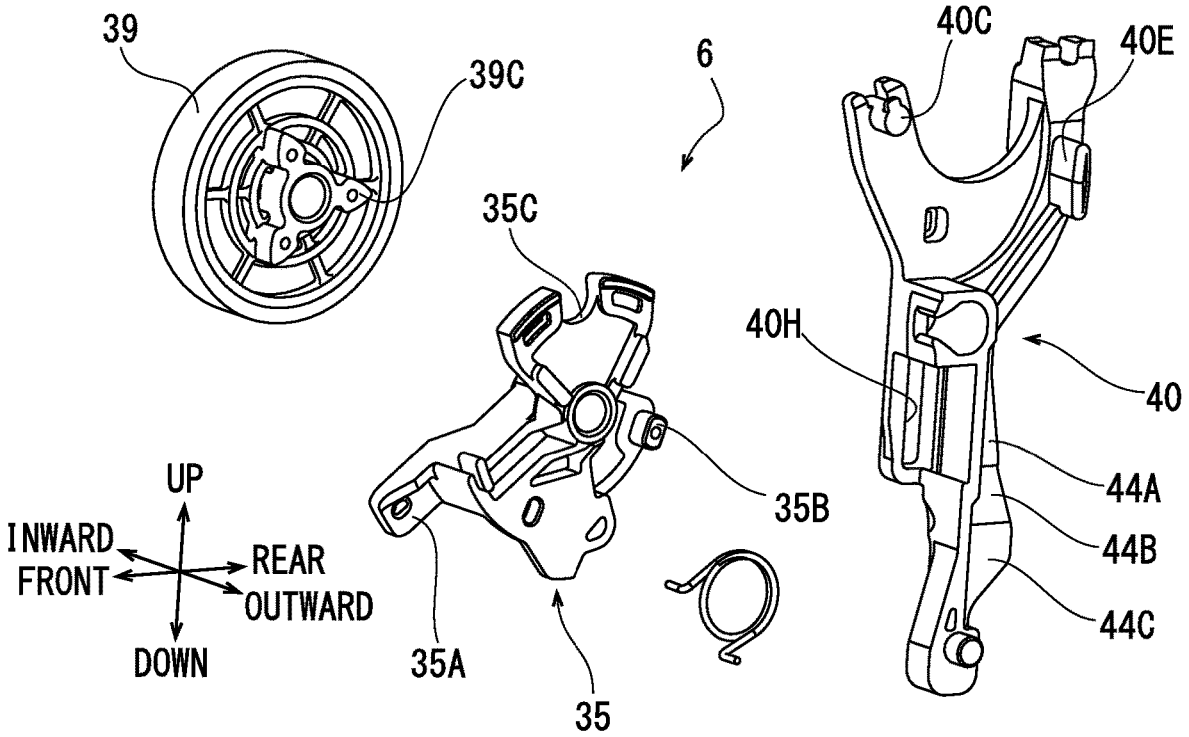

VEHICLE DOOR LOCK APPARATUS

CROSS-REFERENCE

This application claims the priority benefit of Japanese Patent Application Nos. 2016-140590 and 2016-140598, both filed on Jul. 15, 2016, the entire contents of which are incorporated by reference as if fully set forth herein.

TECHNICAL FIELD

The present invention relates to a vehicle door lock apparatus.

BACKGROUND ART

Japanese Patent Laid-Open No. 2002-129806 and Japanese Patent Laid-Open No. 2014-015717 disclose a known vehicle door lock apparatus. These vehicle door lock apparatuses have parts that are affixed to a vehicle frame and parts that are affixed to a door that is openable and closable with respect to the vehicle frame. These vehicle door lock apparatuses are capable of holding the door closed with respect to the vehicle frame. For this purpose, these vehicle door lock apparatuses include a latch housing, a latch mechanism, an actuating housing, and an actuating mechanism.

In the vehicle door lock apparatus described in JP 2002-129806, a latch chamber is formed in the interior of the latch housing. The latch mechanism is housed in the latch chamber. The latch mechanism is capable of holding the door closed with respect to the vehicle frame. The actuating housing is assembled onto the latch housing. A housing chamber is formed in the interior of the actuating housing. The actuating mechanism is housed in the housing chamber and is capable of actuating the latch mechanism.

As shown in FIGS. 3 and 4 of JP 2002-129806, the actuating housing includes a first case section (housing main body) that functions as a first housing and a second cover body that functions as a second housing. The second cover body is assembled onto the first case section (the housing main body). The housing chamber is formed in the interior of the first case section (the housing main body) and the second cover body after they have been joined together.

In the first case section (the housing main body), a cylindrical shaft is formed as a projection that extends toward the second cover body from a proximal end to a distal end. In the second cover body, a receptacle is formed so as to be in contact with the distal end of the cylindrical shaft. The cylindrical shaft and the receptacle are fastened together by a screw.

In the vehicle door lock apparatus described in JP 2014-015717, as shown in FIG. 5, the latch housing includes a base plate and a first cover body that serves as a third housing. The base plate is fixed to the door. The first cover body is assembled onto the base plate and, together with the base plate, forms the latch chamber in the interior thereof.

As shown in FIG. 4 of JP 2014-015717, the first cover body is joined by two screws to the housing main body and to the second cover body at two places above and below with the first cover body held between the housing main body and the second cover body.

In these above-described known vehicle door lock apparatuses, the cylindrical shaft and the receptacle need to be fastened by the screw during assembly. More specifically, it is necessary to hold a screw, insert the screw through the receptacle from the outer side of the second cover body and then screw the screw into the cylindrical shaft. Furthermore, to waterproof the housing chamber, the periphery of the hole, through which the screw is inserted, in the second cover body must be sealed. Therefore, it is difficult to simplify the work during assembly of such vehicle door lock apparatuses.

SUMMARY OF THE INVENTION

In view of the circumstances above, a vehicle door lock apparatus is disclosed that is designed to simplify the work during assembly.

In one embodiment of the present teachings, a vehicle door lock apparatus is configured to be fixed to a door that is openable and closable relative to a vehicle frame and is capable of holding the door in a closed state with respect to the vehicle frame. The vehicle door lock apparatus preferably comprises:

- a latch housing, a latch chamber being formed in the interior of the latch housing;
- a latch mechanism housed in the latch chamber and capable of holding (retaining) the door closed with respect to the vehicle frame;
- an actuating housing assembled onto the latch housing, a housing chamber being formed in the interior of the actuating housing; and
- an actuating mechanism housed in the housing chamber and capable of actuating the latch mechanism, wherein:
- the actuating housing includes a first housing made of resin assembled or joined to a second housing made of resin, the housing chamber being formed in the interior of the first and second housings,
- in the first housing, at least one projection extends toward the second housing from a proximal end to a distal end, and
- in the second housing, at least one receptacle has a contact part that is welded to the distal end to affix the projection.

In the vehicle door lock apparatus according to the above-described embodiment, the distal end of the at least one projection formed in the first housing is welded (e.g., plastic welded or otherwise fused) to the contact part of the at least one receptacle formed in the second housing. That is, during assembly, a heating source, such as an ultrasonic transducer or a laser beam, only has to be disposed at the to-be-welded part of the distal end and the contact part to heat the to-be-welded part. Therefore, as compared with fastening by using screws, it is possible to reduce work during assembly.

Therefore, in the vehicle door lock apparatus according to the above-described embodiment, it is possible to achieve simplification of the assembly work.

The actuating mechanism preferably includes an actuating member supported by the at least one projection so as to be pivotable, turnable (rotatable), or linearly movable relative to the projection. In such an embodiment, it is possible to simplify the component (structure) that supports the actuating member so as to be pivotable, turnable (rotatable), or linearly movable.

A striker is preferably fixed to the vehicle frame. The vehicle door lock apparatus is preferably fixed to the door. An entry opening, which the striker is designed to enter and be held in in order to hold the door in its closed state, is preferably formed in the latch housing. The latch mechanism preferably includes a fork that is pivotable in the latch housing and can be displaced to a latch position for retaining the striker in the entry opening and to as unlatch position for allowing the striker to separate (exit) from the entry opening.

The latch mechanism also includes a pawl that is pivotable in the latch housing to fix or open the fork. The at least one projection preferably includes a first shaft and a second shaft, i.e. at least two projections are provided. In such an embodiment, two of the receptacles are preferably provided, in which one is a first shaft receptacle corresponding to (disposed to contact) the first shaft and the second is a second shaft receptacle corresponding to (disposed to contact) the second shaft. The actuating member preferably includes (i) a first lever that acts on the pawl by being displaced and is capable of causing the pawl to open the fork, (ii) a second lever pivotably supported by the first shaft, operably coupled to a door handle at a first end, and capable of pivoting in response to an opening operation performed on the door handle to act on the first lever and displacing the first lever, and (iii) a third lever pivotably supported by the second shaft, coupled to a lock operator at a first end, and capable of pivoting in response to a locking operation or an unlocking operation performed on the lock operator to act on the first lever and displace the first lever to an unlock position where the first lever is capable of acting on the pawl and to a lock position where the first lever is incapable of acting on the pawl.

In such an embodiment, a distal end of the first shaft and a contact part of the first shaft receptacle are welded (e.g., plastic welded or otherwise fused). A distal end of the second shaft and a contact part of the second shaft receptacle are also welded (e.g., plastic welded or otherwise fused). Therefore, it is possible to further simplify the work during assembly.

The vehicle door lock apparatus according to any of the above-described embodiments preferably includes an electronic component housed in the housing chamber. The first housing preferably includes a first peripheral edge section surrounding a first base wall. The second housing preferably includes a second peripheral edge section surrounding a second base wall. The housing chamber is preferably formed by welding (e.g., plastic welding or otherwise fusing) the first peripheral edge section to the second peripheral edge section with the first base wall disposed so as to oppose the second base wall.

In such an embodiment, when the distal ends of the first and second shafts are respectively welded or otherwise fused to the contact parts of the first and second shaft receptacles, the first peripheral edge section can also be welded to the second peripheral edge section. Therefore, it is possible to further simplify the work during assembly. By welding the first peripheral edge section to the second peripheral edge section, it is possible to prevent the ingress of water or other foreign matter into the housing chamber even if a seal or gasket is not disposed between the first peripheral edge section and the second peripheral edge section. Therefore, it is possible to prevent malfunctions of the electronic component caused by the ingress of foreign matter.

The at least one projection preferably further includes a third shaft. The at least one receptacle preferably farther includes a third shaft receptacle corresponding to the third shaft. The electronic component of the actuating mechanism preferably includes an electric motor. The actuating member preferably further includes a worm wheel rotatably (turnably) supported by (on) the third shaft, driven to rotate by the electric motor to cause the third lever to pivot, and capable of switching the first lever from the unlock position to the lock position and vice versa.

In such an embodiment, when the distal ends of the first and second shafts are respectively welded or fused to the contact parts of the first and second shaft receptacles, a distal end of the third shaft can also be welded or fused to a contact part of the third shaft receptacle. Therefore, it is possible to further simplify the work during assembly.

The at least one projection preferably further includes a fourth shaft. The at least one receptacle preferably further includes a fourth shaft receptacle corresponding to the fourth shaft. The actuating member preferably includes a fourth lever supported by the fourth shaft so as to be linearly movable, capable of being displaced to a locked position where the first lever is retained in a lock position and to an unlocked position where the first lever is not retained in the lock position. In the unlocked position, the fourth lever enables the fork, when in the latch position, to be displaced to the unlatch position and, in the locked position, disables (prevents) the fork, when in the latch position, from being displaced to the unlatch position. The third lever preferably displaces the fourth lever from the unlocked position to the locked position in response to the locking operation and displaces the fourth lever from the locked position to the unlocked position in response to the unlocking operation.

In such an embodiment, when the distal ends of the first and second shafts are respectively welded or fused to the contact parts of the first and second shaft receptacles, a distal end of the fourth shaft can also be welded or fused to a contact part of the fourth shaft receptacle. Therefore, it is possible to further simplify the work during assembly.

The latch housing preferably includes a base plate made of metal fixed to the door and a third housing made of resin assembled onto the base plate and forming the latch chamber in the interior together with the base plate. In the first housing, at least two supports preferably each extend toward the second housing from a proximal end to a distal end via an intermediate segment. The third housing has insertion-through holes, through which the intermediate segments of the supports are respectively inserted. In the second housing, slip-off preventing parts preferably align with the distal ends of the supports.

In such an embodiment, the intermediate segments of the supports formed in (on) the first housing are respectively inserted through the insertion-through holes formed in the third housing to assemble the second housing onto the first housing. Consequently, the slip-off preventing parts formed in the second housing align with the distal ends of the supports to prevent the distal ends from slipping off. That is, in such a vehicle door lock apparatus, it is not necessary to perform fastening work using screws when the third housing is assembled onto the first and second housings. When the distal ends of the first and second shafts are respectively welded or fused to the contact parts of the first and second shaft receptacles, the distal ends of the supporting sections can also be respectively welded or fused to the slip-off preventing parts. Therefore, it is possible to further simplify the work during assembly.

One of the first housing and the second housing is preferably forms by (of) a light absorptive material. The other of the first housing and the second housing is preferably formed by (of) a light transmissive material. In such an embodiment, the welding can be performed by laser transmission welding (laser plastic welding). As a result, in such a vehicle door lock apparatus, it is possible to achieve more precise and highly flexible (customized) welding than ultrasonic welding.

On the distal end and the contact part, spacing setting surfaces that come into contact with each other without being melted (fused or otherwise integrally joined) preferably set the spacing between the first housing and the second housing. In ultrasonic welding, fractional heat occurs along the entire range in which the second base wall and the first distal end and the second distal end are in contact. In this regard, the spacing between the first and second base walls can be accurately set by providing the spacing setting surfaces and by not irradiating the laser beam on the spacing setting surfaces when the laser transmission welding is being performed.

The at least one receptacle preferably includes a fitting part formed to surround the contact part and to fit with the distal end. In such an embodiment, the fitting part fits with the distal end, whereby the contact part can be accurately positioned relative to the distal end.

In the known vehicle door look apparatus described in JP 2014-015717, when the first cover body is assembled onto the housing main body and the second cover body, these parts must be fastened using screws. It is therefore difficult to simplify the work during assembly when using this known screw-fastening technique.

In another embodiment of the present teachings, a vehicle door lock apparatus according to a different configuration can also achieve simplification of the work during assembly.

Such a vehicle door lock apparatus also is fixed to a door that is openable and closable relative to a vehicle frame and is capable of holding the door closed with respect to the vehicle frame. This vehicle door lock apparatus comprises:

- a latch housing, a latch chamber being formed in the interior of the latch housing;
- a latch mechanism housed in the latch chamber and capable of holding the door closed with respect to the vehicle frame;
- an actuating housing assembled onto the latch housing, a housing chamber being formed in the interior of the actuating housing; and
- an actuating mechanism housed in the housing chamber and capable of actuating the latch mechanism, wherein:
- the actuating housing includes a first housing made of resin and a second housing made of resin assembled onto the first housing and forming the housing chamber together with the first housing,
- the latch housing includes a base plate made of metal configured to be fixed to the door and a third housing made of resin assembled onto the base plate and forming the latch chamber together with the base plate,
- in the first housing, at least two supports extend toward the second housing, each from a proximal end to a distal end via an intermediate segment,
- the third housing has insertion-through holes, through which the intermediate segments of the supports are respectively inserted, and
- the second housing includes slip-off preventing parts respectively aligned with the distal ends.

In such a vehicle door lock apparatus, the intermediate segments of the supports formed in (on) the first housing are respectively inserted through the insertion-through holes formed in the third housing to assemble the second housing onto the first housing. Consequently, the slip-off preventing parts formed in the second housing respectively align with the distal ends of the supports to prevent the distal ends from slipping off. That is, in such a vehicle door lock apparatus, screws are not required for fastening when the third housing is assembled onto the first and second housings.

In such an embodiment as well, one of the first housing and the second housing is preferably formed by (of) a light absorptive material. The other of the first housing and the second housing is preferably formed by (of) a light transmissive material. In such an embodiment, when the third housing is assembled onto the first and second housings, the first housing can be assembled onto (joined to) the second housing by laser transmission welding (laser plastic welding). The distal ends of the supports of the first housing can be respectively welded to the slip-off preventing parts of the second housing by the laser transmission welding. As a result, in such a vehicle door lock apparatus, it is possible to further simplify the work during assembly and firmly integrate (join) the third housing with the first and second housings.

In this embodiment as well, a striker is preferably fixed to the vehicle frame. The vehicle door lock apparatus is preferably fixed to the door. An entry opening, which the striker is designed to enter and be held in, is preferably formed in the latch housing. The latch mechanism preferably includes a fork that is pivotable in the latch housing and displaced to a latch position for retaining the striker in the entry opening and to an unlatch position for allowing the striker to separate (exit) from the entry opening. A pawl is pivotable in the latch housing to fix or open the fork. In the first housing, a lever shaft preferably extends toward a third housing from a proximal end to a distal end. The actuating mechanism preferably includes an open lever that is pivotable about the lever shaft, coupled to a door handle at a first end, and capable of pivoting in response to an opening operation performed on the door handle to act on the pawl and cause the pawl to open the fork. The third housing includes a shaft receptacle having a fitting part, which fits with the distal end for affixing the lever shaft.

In such an embodiment, when the third housing is assembled onto the first and second housings, the distal end of the lever shaft formed in the first housing fits with the fitting part of the shaft receptacle formed in the third housing, whereby it is possible to fix the lever shaft while preventing the open lever supported by the lever shaft from slipping off. As a result, in such a vehicle door lock apparatus, it is possible to further simplify the work during assembly.

The first housing preferably includes a guide that guides the third housing so that the supports are respectively inserted through the insertion-through holes. In such an embodiment, it is possible to easily carry out, by using the guide, the work to insert the supports through the insertion-through holes.

BRIEF DESCRIPTION OF THE DRAWINGS

FIG. 8 is a perspective view of a second housing of the first embodiment.

FIG. 9 is an exploded perspective view of a worm wheel, an inside (I/S) lock lever, and a linearly moving lock lever of the first embodiment.

DETAILED DESCRIPTION OF EXEMPLARY EMBODIMENTS

Embodiments of the present teachings will be explained below with reference to the drawings.

First Embodiment

Figure 1:
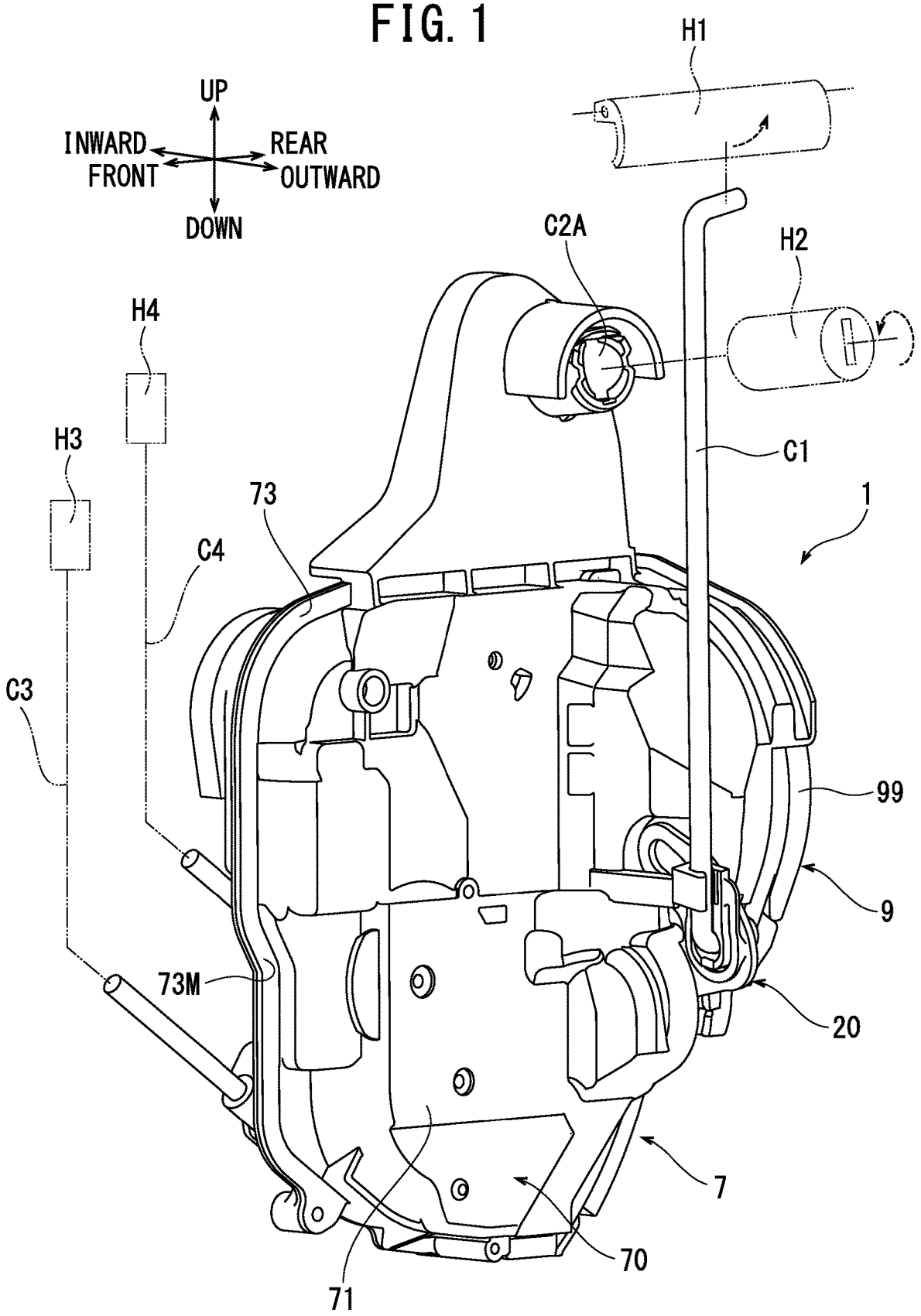
FIG. 1 is a perspective view of a vehicle door lock apparatus according to a first embodiment of the present teachings.
Figure 2:
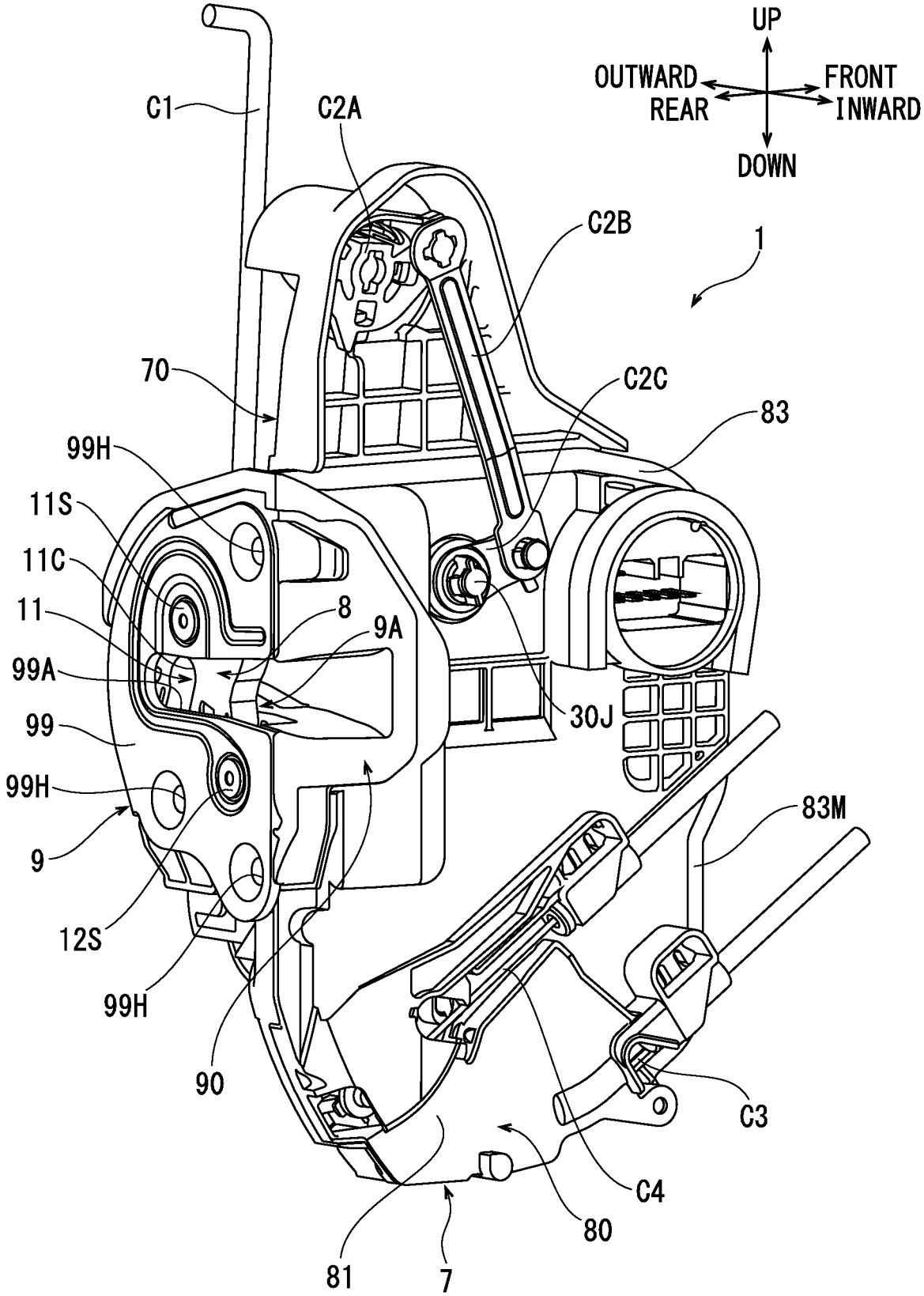
FIG. 2 is a perspective view of the vehicle door lock apparatus.

FIGS. 1 and 2 show a vehicle door lock apparatus 1 according to a representative, non-limiting first embodiment (hereinafter sometimes referred to as simply "door lock apparatus 1") of the present teachings. Although not shown in these Figures, the door lock apparatus 1 is configured to be affixed (attached) to a door that is openable and closable relative to a vehicle frame (chassis) of a vehicle, such as an automobile, a bus, a commercial vehicle, a truck, etc. By retaining (latching or holding) a striker that is affixed to the vehicle frame, the door lock apparatus 1 is capable of retaining (holding) the door closed with respect to the vehicle frame.

In FIGS. 1 and 2, the door lock apparatus 1 is configured to be disposed on the inside at the rear end of the door provided on the left side surface of the vehicle frame. It is noted that, when another door lock apparatus 1 is affixed to the rear end of the door provided on the right side surface of the vehicle frame, the two door lock apparatus 1 will be disposed in a mirror image state. In addition or in the alternative, the door lock apparatus 1 according to the present teachings can be provided in (on) a tail gate, or another portion of the vehicle.

The front-rear direction and the up-down direction shown in FIGS. 1 and 2 are based on (correspond to) the front-rear direction and the up-down direction of the vehicle. The vehicle inward-outward direction shown in FIGS. 1 and 2 is based on a person sitting in the cabin of the vehicle. The left surface side of the vehicle is set as the vehicle exterior and the opposite side is set as the vehicle interior. The front-rear direction, the up-down direction, and the vehicle inward-outward direction shown in FIG. 3 and the reference directions shown in the subsequent Figures correspond to the reference directions shown in FIGS. 1 and 2.

As shown in FIG. 1, an exterior door handle H1 and a key cylinder H2 are disposed on the outer surface of a not-shown door, to which the door lock apparatus 1 is affixed. An interior door lock knob H3 and an interior door handle H4 are disposed on the inner surface of the door that is exposed to (faces) the cabin of the vehicle. The interior door lock knob H3 is a representative, non-limiting example of a "lock operator" according to the present teachings. The interior door handle H4 is a representative, non-limiting example of a "door handle" according to the present teachings. The exterior door handle H1 is a representative, non-limiting example of a "door handle" according to the other teaching.

The upper end portion of a transmission rod C1 is operably coupled to the exterior door handle H1. The door lock apparatus 1 is disposed downward of the exterior door handle H1 on the inside of the door. The lower end portion of the transmission rod C1 is operably coupled to an outside (O/S) open lever 20 of the door lock apparatus 1.

The key cylinder H2 is retained so as to be rotatable integrally with a key-cylinder retainer C2A, which is rotatably (turnably) provided at the upper end portion of the door lock apparatus 1. As shown in FIG. 2, the upper end of a link rod C2B is operably coupled to the key-cylinder retainer C2A. The lower end of the link rod C2B is connected to an outside (O/S) lock lever 30, which will explained below with reference to FIG. 5, etc., via a link lever C2C.

As shown in FIG. 1, a first end of a transmission cable C3 is connected to the interior door lock knob H3. A first end of a transmission cable C4 is connected to the interior door handle H4. As shown in FIG. 2, a second end of the transmission cable C3 is drawn into the door lock apparatus 1 and connected to an inside (I/S) lock lever 35, which will, be explained below with reference to FIG. 5, etc. A second end of the transmission cable C4 is drawn into the door lock apparatus 1 and connected to an inside (I/S) open lever 25, which will also be explained below with reference to FIG. 5, etc.

The door lock apparatus 1 includes a latch housing 9, as shown in FIGS. 1-4, and an actuating housing 7, as shown in FIGS. 1, 2, and 5-8. As shown in FIGS. 1 and 2, the actuating housing 7 is assembled onto (joined to) the latch housing 9.

Figure 5:
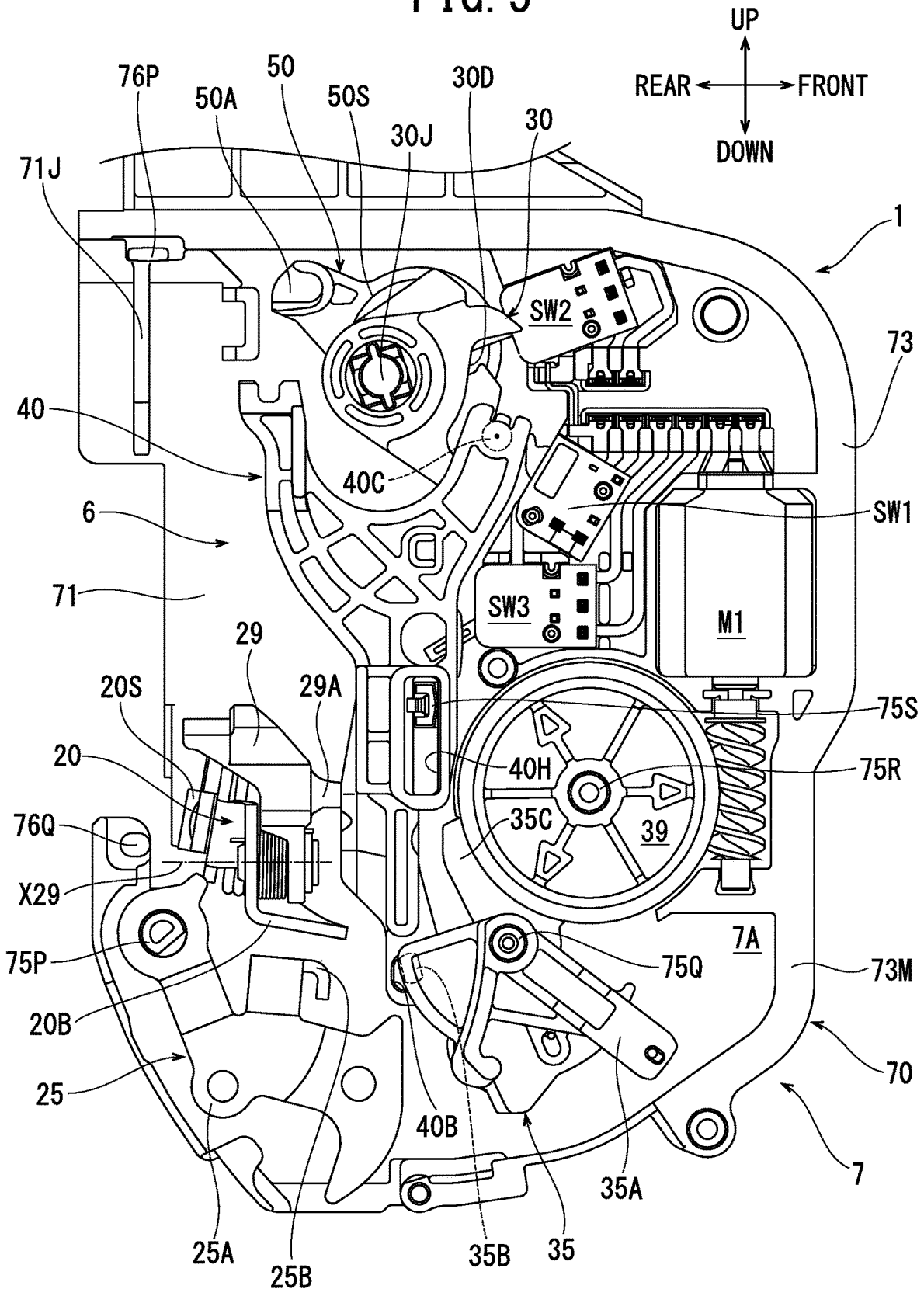
FIG. 5 is a front view of a first housing and an actuating mechanism of the first embodiment.
Figure 6:
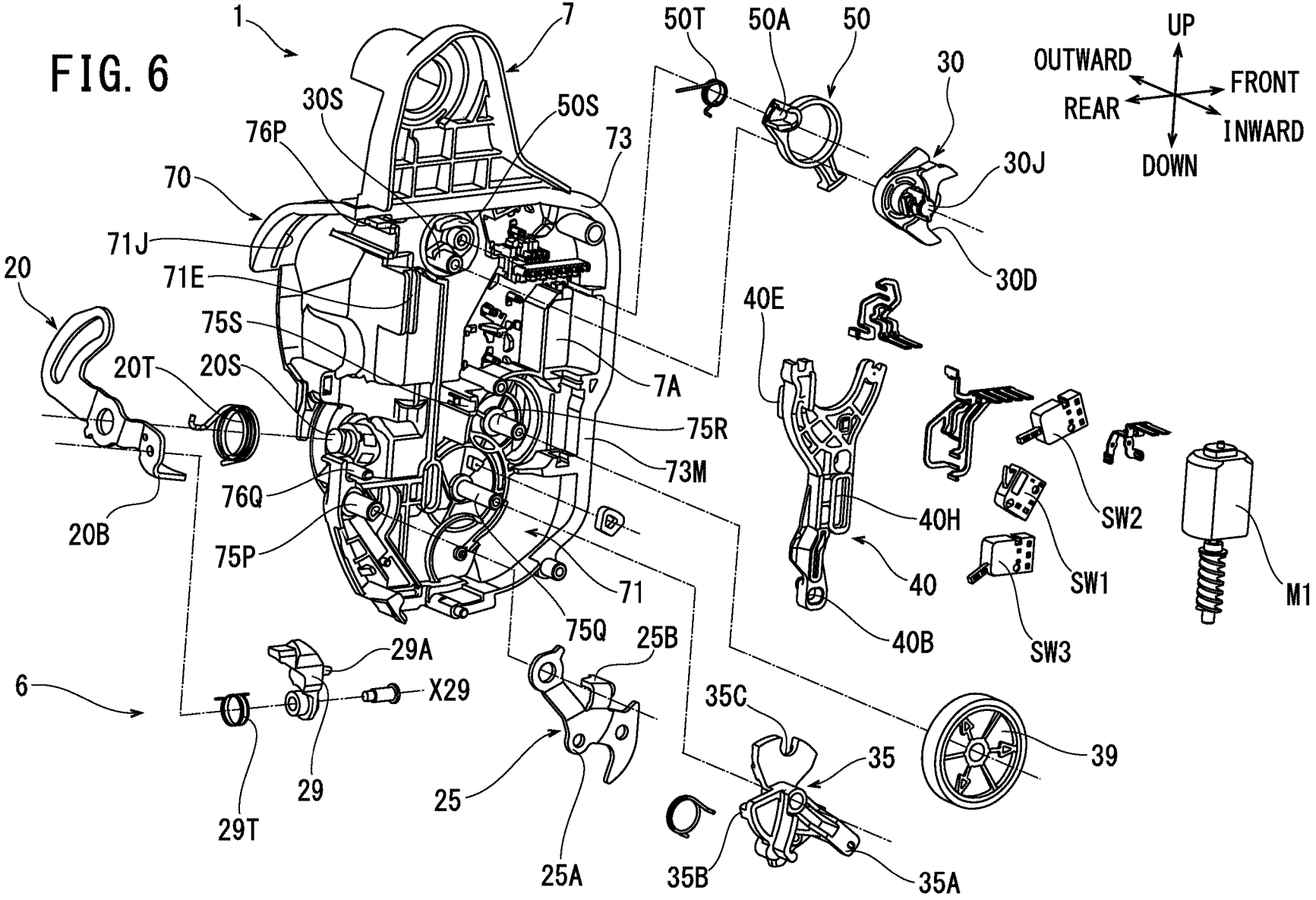
FIG. 6 is an exploded perspective view of the first housing and the actuating mechanism.
Figure 7:
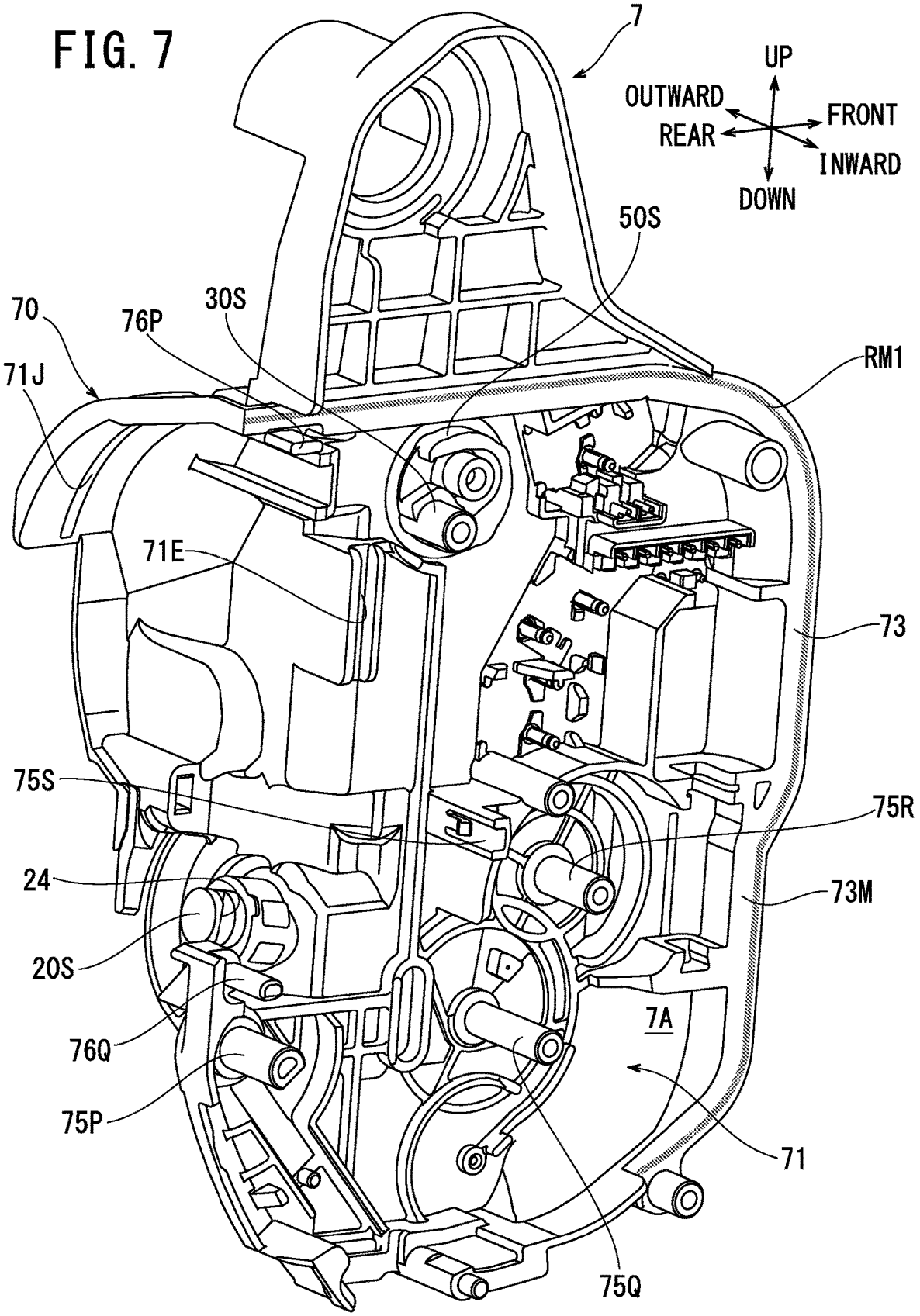
FIG. 7 is a perspective view of the first housing.

As shown, e.g., in FIGS. 6-8, the actuating housing 7 includes a first housing 70 and a second housing 80, each made of resin. As shown in FIG. 1, the first housing 70 includes a first peripheral edge section 73 surrounding a first base wall 71. As shown in FIG. 8, the second housing 80 includes a second peripheral edge section 83 surrounding a second base wall 81. The second housing 80 is assembled onto (joined to) the first housing 70, whereby a housing chamber 7A is formed in the interior of the actuating housing 7. An actuating mechanism 6, as shown in FIGS. 5, 6, and 9-16, is housed in the housing chamber 7A.

Figure 4:
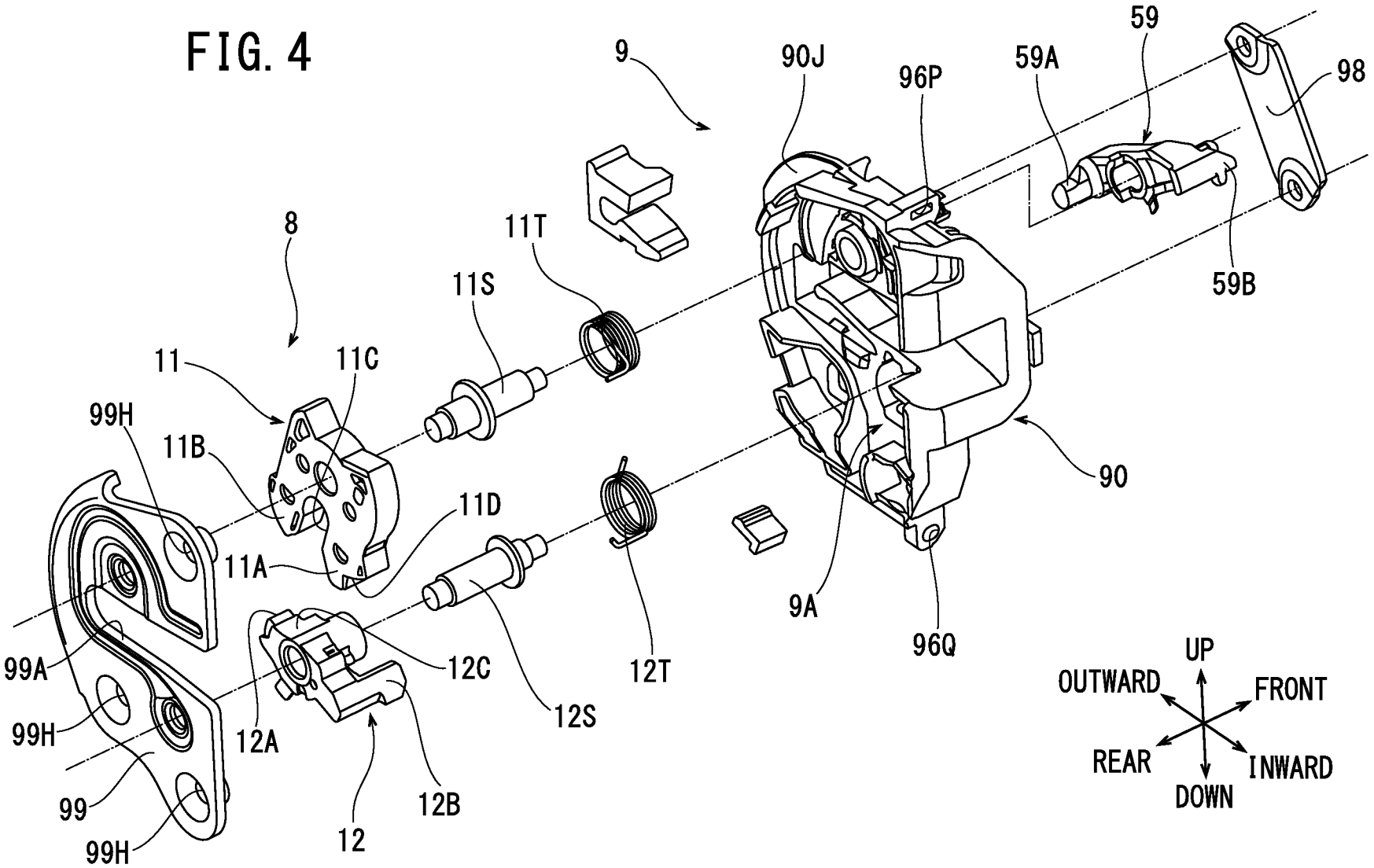
FIG. 4 is an exploded perspective view of the latch housing and the latch mechanism.

As shown in FIG. 4, the latch housing 9 includes a third housing 90 made of resin, as well as a base plate 99 and a back plate 98, which are each made from steel plate. A fork pivot shaft 11S and a pawl pivot shaft 12S are inserted through the third housing 90. The base plate 99 is disposed behind the third housing 90. The back plate 98 is disposed in front of the third housing 90. The rear end portions of the fork pivot shaft 11S and the pawl pivot shaft 12S are respectively crimped and thereby affixed to the base plate 99. The front end portions of the fork pivot shaft 11S and the pawl pivot shaft 12S are respectively crimped and thereby affixed to the back plate 98, whereby a latch chamber 9A is formed in the interior of the latch housing 9. A latch mechanism 8, as shown in FIGS. 2, 4, and 11-14, is housed in the latch chamber 9A.

A plurality of fixing holes 99H and an entry opening 99A are formed in the base plate 99. Not-shown set screws are inserted through the rear end face of the door and respectively screwed into the fixing holes 99B of the base plate 99, whereby the door lock apparatus 1 is affixed to the door such that the entry opening 99A is exposed to the rear end face of the door. When the door lock apparatus 1 moves in accordance with the opening and closing of the door, the striker affixed to the vehicle frame respectively enters or separates (exits) from the entry opening 99A.

The assembly of the first housing 70, the second housing 80, and the third housing 90 will now be explained.

In this embodiment, the first housing 70 is formed by (of) a light absorptive resin material. The second housing 80 is formed by (of) a light transmissive resin material. It is noted that the same base resin material may be utilized for both the first housing 70 and second housing 80, but the light transmission/absorption properties may be changed (modified) from light absorptive to light transmissive, or vice versa, by adjusting of the amounts of additive(s), colorant(s), etc.

Figure 17:
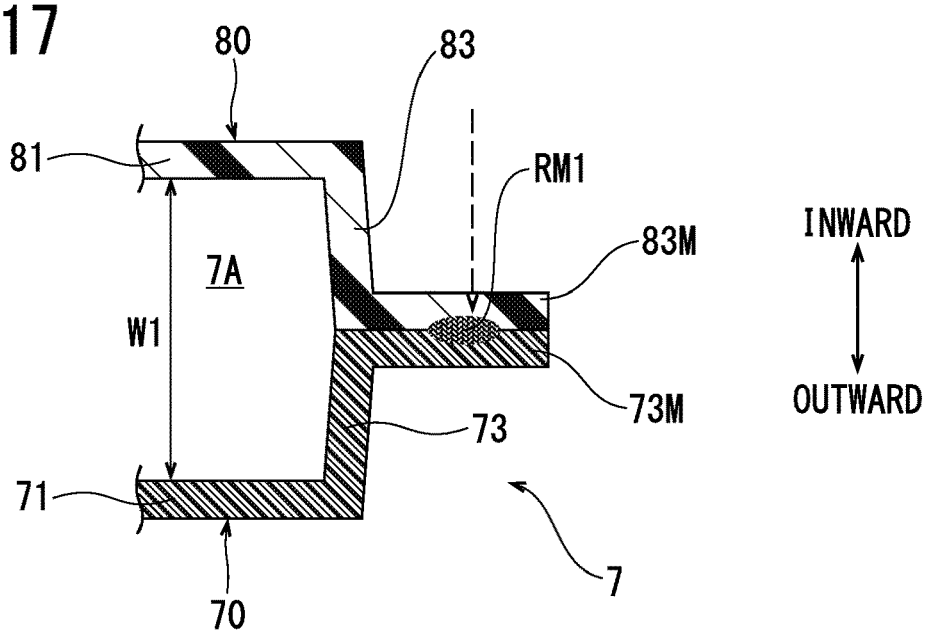
FIG. 17 is a schematic sectional view showing a first peripheral edge section of the first housing welded to a second peripheral edge section of the second housing by laser transmission welding.

As shown in FIGS. 7 and 17, the first peripheral edge section 73 continues to the peripheral edge of the first base wall 71 and extends toward the vehicle exterior. The first peripheral edge section 73 includes a first welded section 73M that extends in a flange shape in a direction away from the first base wall 71.

As shown in FIGS. 8 and 17, the second peripheral edge section 83 continues to the peripheral edge of the second base wall 81 and extends toward the vehicle interior. The second peripheral edge section 83 includes a second welded section 83M that extends in a flange shape in a direction away from the second base wall 81.

As shown in FIG. 17, when the first base wall 71 opposes the second base wall 81 and the first welded section 73M of the first peripheral edge section 73 faces the second welded section 83M of the second peripheral edge section 83, the first welded section 73M is welded or otherwise fused to the second welded section 83M, e.g., by laser transmission welding (laser plastic welding), whereby the second housing 80 and the first housing 70 are (integrally) joined, i.e. portions thereof are fused together.

Region RM1 shown in FIGS. 7, 8, and 17 indicates a region where a melted/fused section is formed when the laser transmission welding is performed. The region RM1 is formed in a continuous curved line shape. Regions, which surround the region RM1 in the first welded section 73M and the second welded section 83M, are in contact without being melted/fused together and set (determine, define) the spacing W1 between the first base wall 71 and the second base wall 81. It is noted that, since the first base wall 71 and the second base wall 81 are not flat, the spacing W1 is a value that differs (varies) for each of the parts of (at different locations between) the first base wall 71 and the second base wall 81.

As shown in FIGS. 5 to 7, a first shaft 75P is formed in a rear and lower part in the first base wall 71 of the first housing 7. A second shaft 75Q is formed in a part farther forward than the first shaft 75P in the first base wall 71. A third shaft 75R and a fourth shaft 75S are formed in a part located substantially in the center of the first base wall 71. The third shaft 75R is located farther forward than the fourth shaft 75S. The first shaft 75P, the second shaft 75Q, the third shaft 75R, and the fourth shaft 75S are representative, non-limiting examples of "projections" according to the present teachings.

Figure 18:
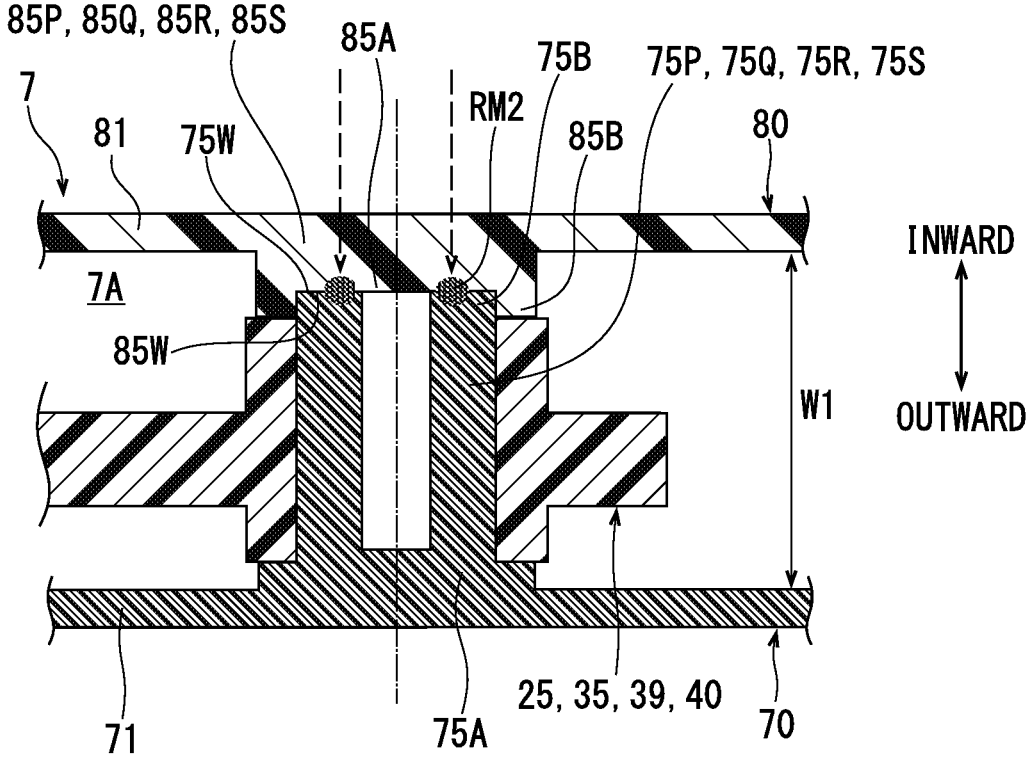
FIG. 18 is a schematic sectional view showing a distal end of a projection of the first housing welded to a contact part of a receptacle of the second housing by laser transmission welding.

As shown in FIG. 18, the first shaft 75P, the second shaft 75Q, the third shaft 75R, and the fourth shaft 75S extend toward the second base wall 81 of the second housing 80, each from a proximal end 75A to a distal end 75B, respectively.

As shown in FIG. 8, a first shaft receptacle 85P is formed in a first part of the second base wall 81 of the second housing 80, which first part corresponds to the location of the distal end of the first shaft 75P when the first and second housings 70, 80 are assembled together. A second shaft receptacle 85Q is formed in a second part of the second base wall 81, which second part corresponds to the location of the distal end of the second shaft 75Q when the first and second housings 70, 80 are assembled together. A third shaft receptacle 85R is formed in a third part of the second base wall 81, which third part corresponds to the location of the distal end of the third shaft 75R when the first and second housings 70, 80 are assembled together. A fourth shaft receptacle 85S is formed in a fourth part of the second base wall 81, which fourth part corresponds to the location of the distal end of the fourth shaft 75S when the first and second housings 70, 80 are assembled together. The first shaft receptacle 85P, the second shaft receptacle 85Q, the third shaft receptacle 85R, and the fourth shaft receptacle 85S are examples of "receptacles" according to the present teachings.

As shown in FIG. 18, the first shaft receptacle 85P, the second shaft receptacle 85Q, the third shaft receptacle 85R, and the fourth shaft receptacle 85S each include a fitting part 85B formed to surround a contact part 85A. The fitting parts 85B are each formed in one of: a cylindrical shape, a shape obtained by cutting out a part of a cylinder, or a square cylindrical shape.

An inside (I/S) open lever 25, an inside (I/S) lock lever 35, a worm wheel 39, and a linearly moving lock lever 40, which will be explained below, are respectively attached to (rotatably supported on) the first shaft 75P, the second shaft 75Q, the third shaft 75R, and the fourth shaft 75S in advance.

Thereafter, the second housing 80 is assembled (mounted) onto the first housing 70, such that the (first) contact part 85A comes into contact with the distal end 75B of the first shaft 75P, whereby the first shaft receptacle 85P fixes the first shaft 75P. The (second) contact part 85A comes into contact with the distal end 75B of the second shaft 75Q, whereby the second shaft receptacle 85Q fixes the second shaft 75Q. The (third) contact part 85A comes into contact with the distal end 75B of the third shaft 75R, whereby the third shaft receptacle 85R fixes the third shaft 75R. Finally, the (fourth) contact part 85A comes into contact with the distal end 75B of the fourth shaft 75S, whereby the fourth shaft receptacle 85S fixes the fourth shaft 75S.

At this time, the respective fitting parts 85B of the first shaft receptacle 85P, the second shaft receptacle 85Q, the third shaft receptacle 85R, and the fourth shaft receptacle 85S respectively fit with (tightly receive) the corresponding distal ends 75B of the first shaft 75P, the second shaft 75Q, the third shaft 75R, and the fourth shaft 75S and accurately position the distal ends 75B.

As shown in FIG. 17, when the first welded section 73M of the first housing 70 is welded to the second welded section 83M of the second housing 80 by the laser transmission welding, at the same time, as shown in FIG. 18, the distal end 75B of the first shaft 75P is welded to the contact part 85A of the first shaft receptacle 85P by the laser transmission welding, the distal end 75B of the second shaft 75Q is welded to the contact part 85A of the second shaft receptacle 85Q by the laser transmission welding, the distal end 75B of the third shaft 75R is welded to the contact part 85A of the third shaft receptacle 85R by the laser transmission welding, and the distal end 75B of the fourth shaft 75S is welded to the contact part 85A of the fourth shaft receptacle 85S by the laser transmission welding.

Region RM2 shown in FIG. 18 indicates a region where a melted/fused structure (i.e. an integrally joined region) is formed when the laser transmission welding is performed. For example, the region RM2 may be formed in an annular shape or may be formed in a circular shape or a polygonal shape. The region RM2 may be, e.g., a continuous or discontinuous line. Spacing setting surfaces 75W and 85W are provided by regions, which are outside of (surround) the region RM2, on the distal end 75B and the contact part 85A. The spacing setting surfaces 75W and 85W are in contact without being melted/fused together and set (determine, define) the spacing W1 between the first base wall 71 and the second base wall 81. It is again noted that the spacing W1 is a value that differs (varies) for each of the parts where the first shaft 75P, the second shaft 75Q, the third shaft 75R, and the fourth shaft 75S are provided, due to the fact that the first and second base walls 71, 81 are not flat.

Figure 19:
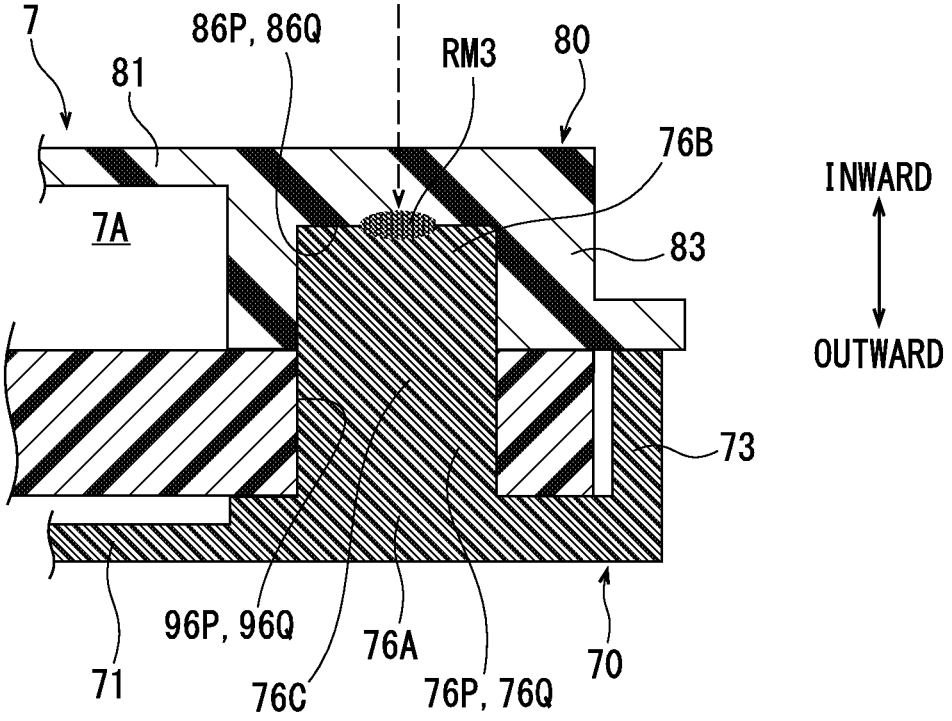
FIG. 19 is a schematic sectional view showing an intermediate segment of a support of the first housing inserted through an insertion-through hole of the third housing and a distal end of the support welded to a slip-off preventing part of the second housing by laser transmission welding.

As shown in FIGS. 5 to 7, two supports 76P and 76Q are formed in (on) the first housing 70. The support 76P projects from the first base wall 71 near a rear and upper end portion in the first peripheral edge section 73 of the first housing 70. The support 76Q projects from the first base wall 71 near a rear and lower end portion in the first peripheral edge section 73 of the first housing 70. As shown in FIG. 19, the supports 76P and 76Q each extend toward the second base wall 81 of the second housing 80 from a proximal end 76A to a distal end 76B via an intermediate segment 76C.

Figure 3:
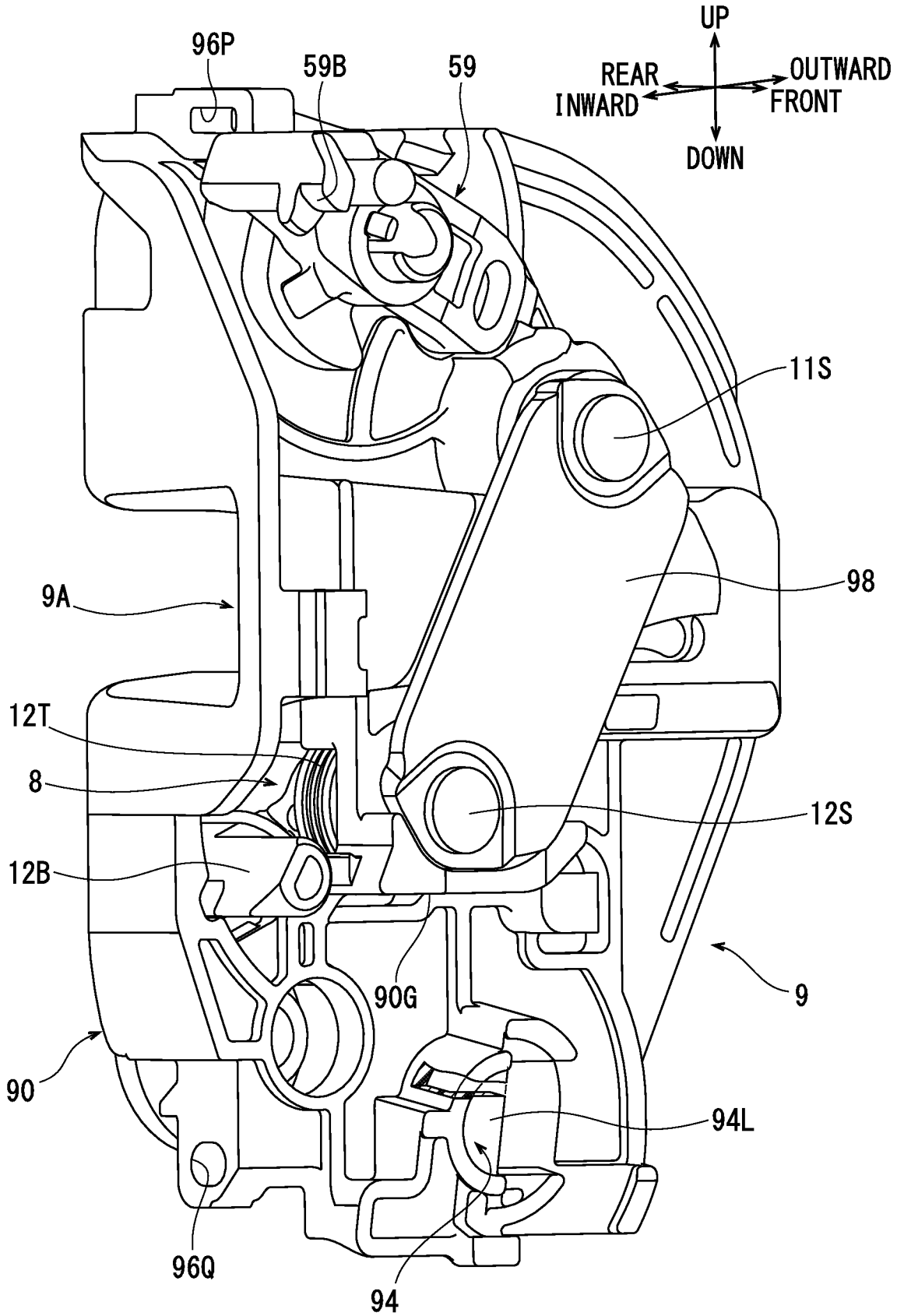
FIG. 3 is a perspective view of a latch housing and a latch mechanism of the first embodiment.

As shown in FIGS. 3 and 4, two insertion-through holes 96P and 96Q are formed in the third housing 90. The insertion-through hole 96P penetrates through the upper end of the third housing 90 in the vehicle inward-outward direction. The insertion-through hole 96Q penetrates through the lower end of the third housing 90 in the vehicle inward-outward direction.

As shown in FIG. 8, two slip-off preventing parts 86P and 86Q are formed as recesses in the second housing 80. The slip-off preventing part 86P is a recess formed near a rear and upper end portion in the second peripheral edge section 83 of the second housing 80. The slip-off preventing part 86P is aligned with the distal end 76B of the support 76P. The slip-off preventing part 86Q is a recess formed near a rear and lower end portion in the second peripheral edge section 83 of the second housing 80. The slip-off preventing part 86Q is aligned with the distal end 76B of the support 76Q.

Before the second housing 80 is assembled onto the first housing 70, the third housing 90 is provisionally assembled (mounted) onto the first housing 70. At this time, as shown, e.g., in FIG. 7, the first housing 70 includes a groove-like guide 71J formed in the rear end portion of the first base wall 71. As shown in FIG. 4, a rib 90J protrudes from an upper end face of the third housing 90 towards the vehicle exterior. By moving the third housing 90 towards to the first housing 70 while guiding the rib 90J into the guide groove 71J, the third housing 90 can be provisionally assembled with the first housing 70 in the proper position (orientation).

As a result, as shown in FIG. 19, the intermediate segment 76C of the support 76P of the first housing 70 is inserted through the insertion-through hole 96P of the third housing 90. Similarly, the intermediate segment 76C of the support 76Q of the first housing 70 is inserted through the insertion-through hole 96Q of the third housing 90.

Subsequently, the second housing 80 is assembled (mounted) onto the first housing 70. In this state, the distal end 76B of the support 76P of the first housing 70 is accurately positioned by fitting the distal end 76B of the support 76P in the slip-off preventing part 86P of the second housing 80. The distal end 76B of the support 76Q of the first housing 70 is accurately positioned by fitting the distal end 76B of the support 76Q in the slip-off preventing part 86Q. The distal ends 76B of the supports 76P and 76Q are respectively in contact with the bottoms of the slip-off preventing parts 86P and 86Q.

As shown in FIG. 17, when the first welded section 73M of the first housing 70 is welded to the second welded section 83M of the second housing 80 by the laser transmission welding, at the same time, as shown in FIG. 19, the distal end 76B of the support 76P is welded to the slip-off preventing part 86P by the laser transmission welding and the distal end 76B of the support 76Q is welded to the slip-off preventing part 86Q by the laser transmission welding. Region EM3 shown in FIG. 19 indicates a region where a melted/fused structure is formed when the laser transmission welding is performed. For example, the region RM3 may be formed in an annular shape or may be formed in a circular shape or a polygonal shape. The region RM3 also may be, e.g., a continuous or discontinuous line.

As shown in FIG. 4, the latch mechanism 8 includes a fork 11 and a pawl 12. The fork 11 is supported by a fork pivot shaft 11S, which is pivotably disposed above the entry opening 99A. A torsion coil spring 11T is attached to the fork pivot shaft 11S. The pawl 12 is supported by a pawl pivot shaft 12S, which is pivotably disposed below the entry opening 99A. A torsion coil spring 12T is attached to the pawl pivot shaft 12S.

Figure 11:
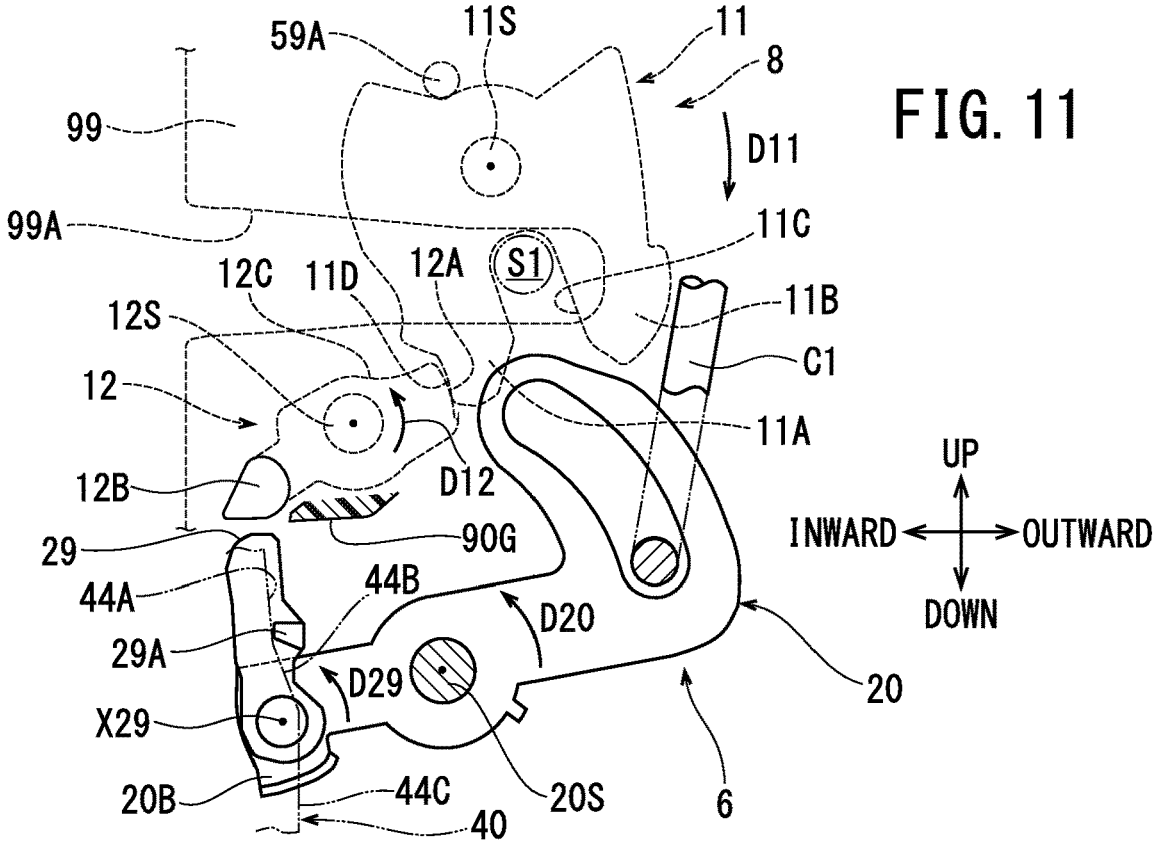
FIG. 11 is a first schematic view for explaining the operation of an outside (O/S) open lever, an inertial lever, a fork, and a pawl of the first embodiment.

As shown in FIG. 11, the fork 11 is urged (biased) by the torsion coil spring 11T so as to pivot in the direction D11 about the fork pivot shaft 11S. The portion of the fork 11 located on the side of the entry opening 99A has an inner convex segment 11A and an outer convex segment 11B. A striker S1, which is shown in FIG. 1 as having entered into the entry opening 99A, fits in a cutout 11C formed between the inner convex segment 11A and the outer convex segment 11B. In the state shown in FIG. 11, the fork 11 retains the striker S1 at the bottom of the entry opening 99A. A latch surface 110 configured to come into contact with a stopper surface 12A, which will be explained below, is formed at (on) the distal end of the inner convex segment 11A that faces the pawl 12.

Figure 21:
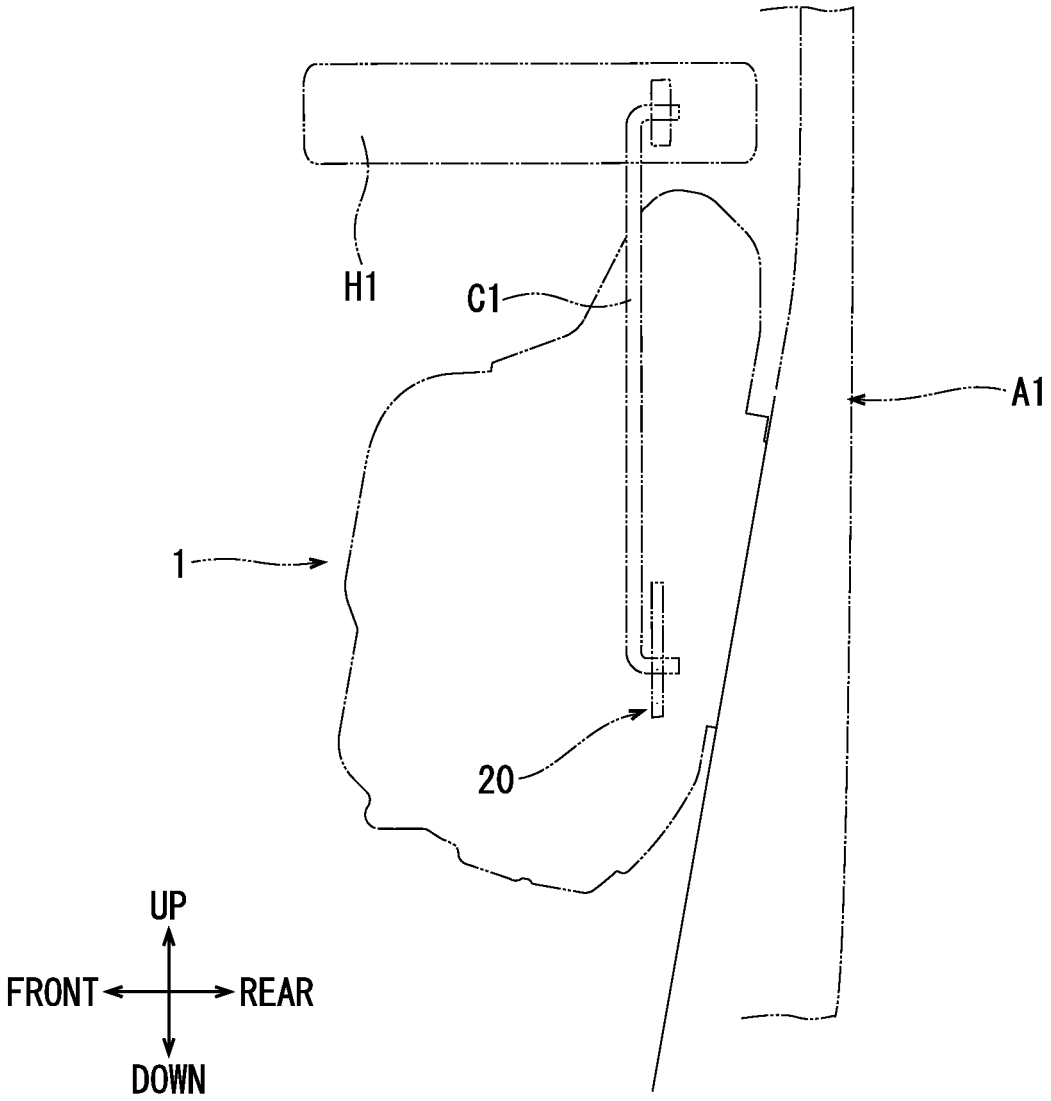
FIG. 21 is a schematic view for explaining the positional relationship of a door handle relative to a transmission rod in an embodiment in which the vehicle door lock apparatus of either embodiment is mounted on, for example, a front door disposed within a vehicle frame.

FIG. 21 is a schematic view for explaining the positional relationship of a door handle relative to a transmission rod in an embodiment in which the vehicle door lock apparatus of either embodiment is mounted on, for example, a front door disposed within a vehicle frame.

The pawl 12 is urged (biased) by the torsion coil spring 12T so as to pivot in the direction D12 about the pawl pivot shaft 12S and holds the posture (orientation) shown in FIG. 11.

The stopper surface 12A is formed in (on) a portion of the pawl 12 that is directed towards the bottom of the entry opening 99A in orientation shown in FIG. 11. The stopper surface 12A is formed so as to face the latch surface 11D. An arc forming the stopper surface 12A is cut on the side that faces the fork 11. A sliding surface 12C that extends to the pawl pivot shaft 12S is formed starting from the part (location) where the arc is cut. A contacted portion 12B is formed on the pawl 12 on the side that is opposite of the stopper surface 12A across the pawl pivot shaft 12S. As shown in FIG. 4, the contacted portion 12B projects forward and has a columnar shape. As shown in FIG. 3, the front end of the contacted portion 12B projects forward from the latch chamber 9A through the third housing 90 and enters the housing chamber 7A.

In FIGS. 1 and 2, the door lock apparatus 1 is configured to be disposed on the inside at the rear end of the door provided on the left side surface of the vehicle frame A1, as shown in FIG. 21. It is noted that, when another door lock apparatus 1 is affixed to the rear end of the door provided on the right side surface of the vehicle frame, the two door lock apparatuses 1 will be disposed in a mirror image state. In addition or in the alternative, the door lock apparatus 1 according to the present teachings can be provided in (on) a tail gate, or another portion of the vehicle.

Figure 12:
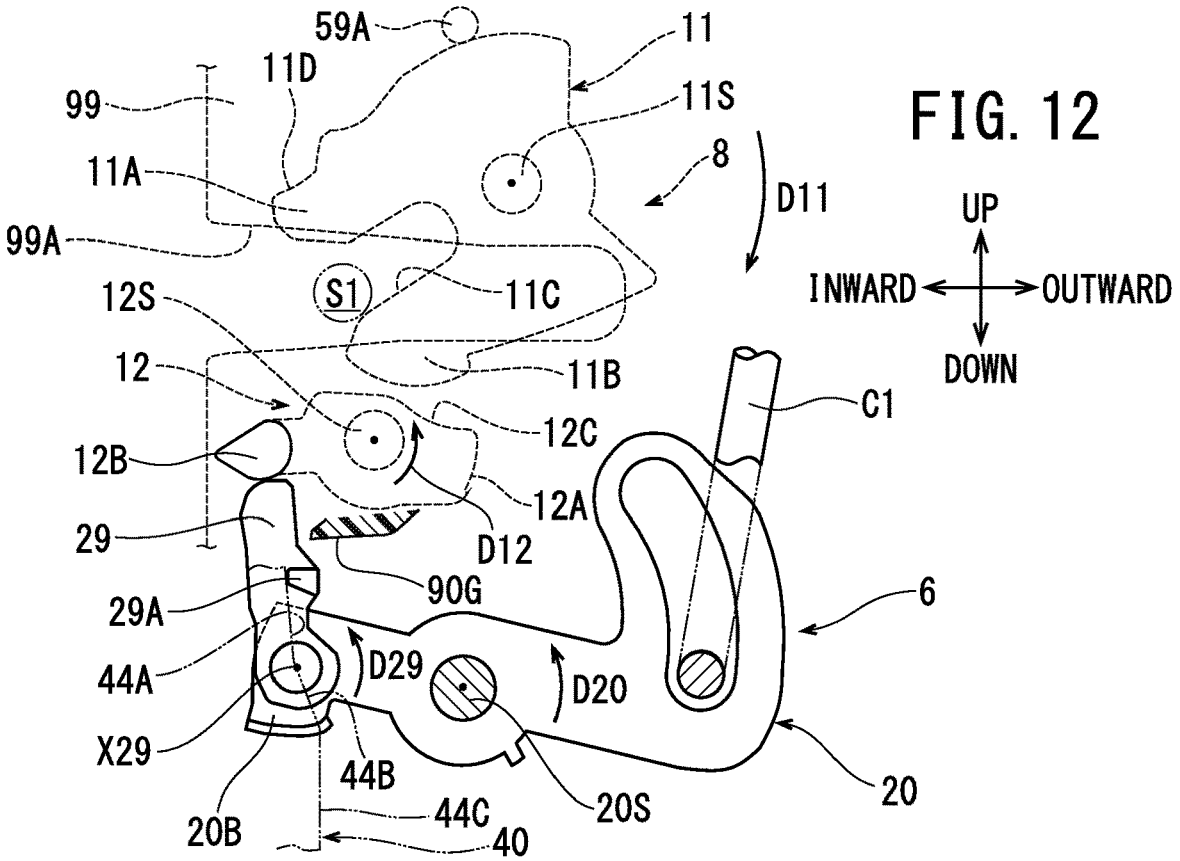
FIG. 12 is a second schematic view for explaining the operation of the O/S open lever, the inertial lever, the fork, and the pawl.

As shown in FIG. 12, when an inertial lever 29, which will be explained below, comes into contact with the contacted portion 12B of the pawl 12 and pushes the contacted portion 12B up, the pawl 12 pivots about the pawl pivot shaft 12S in the direction opposite of the direction D12 by overcoming the urging force of the torsion coil spring 12T. At this time, since the stopper surface 12A separates from the latch surface 11D, the pawl 12 no longer blocks the pivoting movement of the fork 11. Therefore, the fork 11 pivots about the fork pivot shaft 11S in the direction D11 due to the urging force of the torsion coil spring 11T so as to displace to the unlatch position, where the striker S1 is permitted to move out of (exit) the entry opening 99A.

Conversely, when the striker S1 enters the entry opening 99A, the striker S1 pushes against the outer convex segment 11B, thereby causing the fork 11 to pivot in the direction opposite of the direction D11 and to return from the unlatch position shown in FIG. 12 to the latch position shown in FIG. 11. At this time, the distal end of the outer convex segment 11B and then the distal end of the inner convex section 11A sequentially come into slide-contact with the sliding surface 12C. When the inner convex segment 11A separates from the sliding surface 12C, the pawl 12 pivots in the direction D12 and returns to the original posture (position, orientation) shown in FIG. 11. Therefore, the stopper surface 12A comes into contact with the latch surface 11D and fixes (prevents, blocks) the pivoting movement of the fork 11 in the latch position. As a result, the latch mechanism 8 holds the door closed with respect to the vehicle frame.

As shown in FIGS. 3 and 4, a fork following lever 59 is pivotably supported on an upper part of the surface of the third housing 90 on the side of the housing chamber 7A. As shown in FIG. 4, a convex section 59A is formed at a first end portion of the fork following lever 59. As shown in FIGS. 11 and 12, the convex section 59A of the fork following fever 59 is in contact with the outer peripheral surface of the fork 11. Consequently, when the fork 11 displaces from the latch position to the unlatch position or vice versa, the fork following lever 59 pivots following the fork 11. As shown in FIGS. 3 and 4, a convex section 59B is formed at a second end portion of the fork following lever 59. The convex section 59B of the fork following lever 59 projects into the housing chamber 7A.

As shown in FIGS. 5, 6, 9, and 10, the actuating mechanism 6 includes the O/S open lever 20, the I/S open lever 25, the inertial lever 29, the O/S lock lever 30, the I/S lock lever 35, the linearly moving lock lever 40, an electric motor M1, the worm wheel 39, an adjuster SW lever 50, and switches SW1, SW2, and SW3. The electric motor M1 and the worm wheel 39 are also a representative, non-limiting example of a "lock operator" according to the present teachings.

The inertial lever 29 is a representative, non-limiting example of a "first lever" according to the present teachings. The I/S open lever 25 is a representative, non-limiting example of a "second lever" according to the present teachings. The I/S lock lever 35 is a representative, non-limiting example of a "third lever" according to the present teachings. The linearly moving lock lever 40 is a representative, non-limiting example of a "fourth lever" according to the present teachings. The electric motor M1 is a representative, non-limiting example of an "electronic component" according to the present teachings. The O/S open lever 20 is a representative, non-limiting example of an "open lever" according to the other teaching.

As shown in FIGS. 6 and 7, the first housing 70 includes an outside (O/S) open lever pivot shaft 20S that projects rearward at (from) a rear and lower part in the first base wall 71. The O/S open lever pivot shaft 20S is a representative, non-limiting example of a "lever shaft" according to the other teaching. The O/S open lever 20 is pivotably supported by the O/S open lever pivot shaft 20S. As shown in FIG. 6, a torsion coil spring 20T is attached to the O/S open lever pivot shaft 20S. As shown in FIG. 11, the O/S open lever 20 is urged (biased) by the torsion coil spring 20T to pivot about the O/S open lever pivot shaft 20S in the direction D20.

As shown in FIG. 7, a fitting groove 24 is formed as a recess in the O/S open lever pivot shaft 20S. As shown in FIG. 3, a shaft receptacle 94, in which a fitting plate 94L is provided, is formed in the third housing 90. The fitting plate 94L is a representative, non-limiting example of a "fitting part of the shaft receptacle" according to the other teaching. Although not shown in the Figures, the fitting groove 24 of the O/S open lever pivot shaft 20S fits with the fitting plate 94L of the shaft receptacle 94, whereby the O/S open lever 20 is prevented, from slipping off from the O/S open lever pivot shaft 20S.

As shown in FIGS. 1 and 11, a first end of the O/S open lever 20 projects outward of the actuating housing 7. The lower end of the transmission rod C1 is coupled to this first end.

As shown in FIGS. 5 and 6, the inertial lever 29 is supported by a second end 20B of the O/S open lever 20 so as to be pivotable about a pivot axis X29 that extends in the front-rear direction. As shown in FIG. 1, the inertial lever 29 is urged (biased) by a torsion coil spring 29T (shown in FIG. 6) to pivot about the pivot axis X29 in the direction D29.

When the exterior door handle H1 is operated (pulled) to open the door, the transmission rod C1 moves downward, as shown in FIG. 12, and the first end of the O/S open lever 20 is pushed down. As a result thereof, the O/S open lever 20 pivots in the direction opposite of the direction D20 and raises the inertial lever 29.

As shewn in FIGS. 1 and 6, the I/S open lever 25 is pivotably supported by the first shaft 75P. The second end of the transmission cable C4 (see FIGS. 1 and 2) is operably coupled to a first end 25A that is spaced downward from the first shaft 75P in the I/S open lever 25. That is, the I/S open lever 25 is operably coupled to the interior door handle H4 via the transmission cable C4.

As shown in FIGS. 5 and 6, an operating part 25B is formed on a part of the I/S open lever 25 above the first end 25A. The I/S open lever 25 pivots counterclockwise toward the paper surface of FIG. 5 when the interior door handle H4 is palled to open the door. Consequently, the operating part 25B pushes the second end 20B of the O/S open lever 20 up and raises the inertial lever 29.

As shown in FIGS. 6 and 7, the first housing 70 includes an adjuster SW lever pivot shaft 50S that projects from a part above the first base wall 71 toward the vehicle interior. An O/S lock lever pivot shaft 30S projects from the front end face of the adjuster SW lever pivot shaft 50S toward the vehicle interior.

Figure 15:
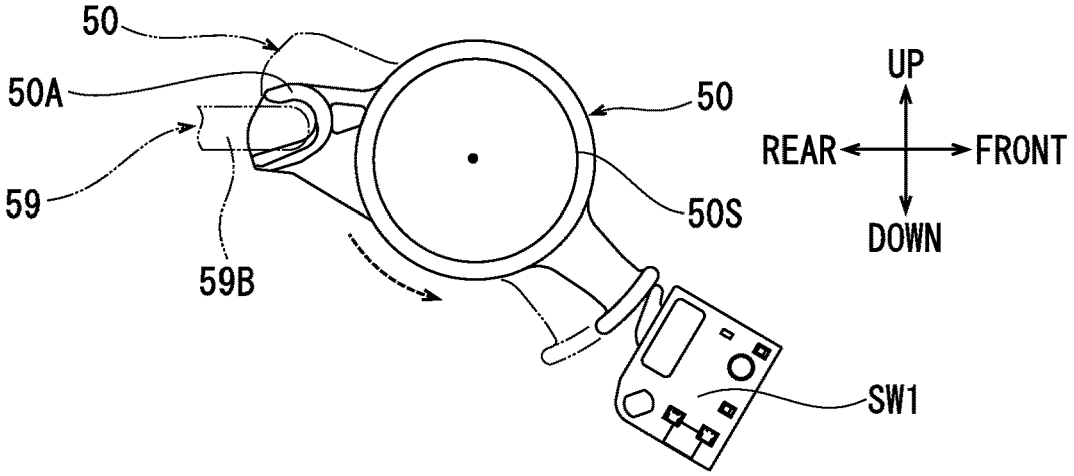
FIG. 15 is a schematic view for explaining the operation of an adjuster SW lever.

As shown in FIGS. 5 and 6, the adjuster SW lever 50 is pivotably supported by the adjuster SW lever pivot shaft 505. The adjuster SW lever 50 is urged (biased) clockwise toward the paper surface of FIG. 5 by a torsion coil spring 50T as shown in FIG. 6. As shown in FIG. 15, the convex segment 59B of the fork following lever 59 shown in FIG. 3 is operably coupled to a first end 50A of the adjuster SW lever 50.

When the fork following lever 59 pivots by following movement of the fork 11 to the unlatch position, the adjuster SW lever 50 pivots from the position indicated by the alternating long and two short dashed line to the position indicated by the solid line in FIG. 15 and turns on the switch SW1. An ON/OFF signal of the switch SW1 is used for the ON/OFF control of the illumination of a cabin lamp in the interior (cabin) of the vehicle.

As shown in FIGS. 5 and 6, the O/S lock lever 30 is pivotably supported by the O/S lock lever pivot shaft 305. An engaging concave segment 30D is formed as a recess in the O/S lock lever 30 and bends in the radial inward direction. The O/S lock lever 30 includes a coupling shaft 30J that projects toward the vehicle interior. As shown in FIG. 2, the coupling shaft 30J projects outward of the second housing 80, The link lever C2C is fixed to the distal end portion of the coupling shaft 30J so as to be integrally rotatable therewith.

Figure 16:
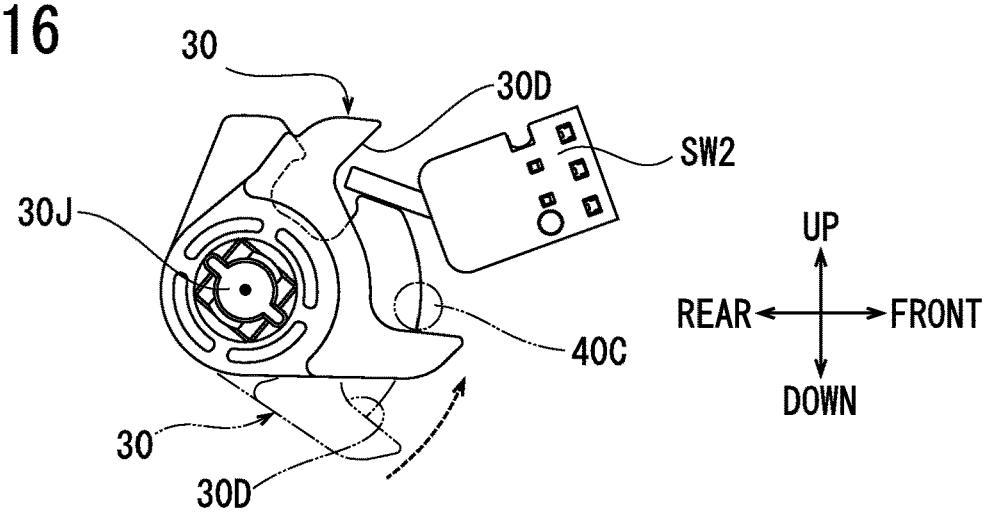
FIG. 16 is a schematic view for explaining the operation of an outside (O/S) lock lever.

The O/S lock lever 30 pivots between a position indicated by the alternating long and two short dashed line and a position indicated by the solid line in FIG. 16 in response to a locking operation or an unlocking operation performed on the key cylinder H2. The position of the O/S lock lever 30 indicated by the alternating long and two short dashed line in FIG. 16 is the same as the position shown in FIGS. 5 and 10. The O/S lock lever 30 pivots to the position indicated by the solid line in FIG. 16 in response to a locking operation performed on the key cylinder H2 and turns on the switch SW2. The ON/OFF signal of the switch SW2 is used to control locking/unlocking of the door and to determine the state of the door lock apparatus 1.

As shown in FIGS. 5 and 6, the I/S lock lever 35 is pivotably supported by the second shaft 75Q. The second end of the transmission cable C3 (shown in FIGS. 1 and 2) is coupled to a first end 35A of the I/S lock lever 35. That is, the I/S lock lever 35 is operably coupled to the interior door lock knob H3 via the transmission cable C3. The I/S lock lever 35 pivots from the position shown in FIG. 5 to the position shown in FIG. 10 in response to a locking operation performed on the interior door lock knob H3. The I/S lock lever 35 pivots from the position shown in FIG. 10 to the position shown in FIG. 5 in response to an unlocking operation performed on the interior door lock knob H3.

As shown in FIGS. 5 and 6, a cam 35C is formed in an upper part of the I/S lock lever 35. As shown in FIG. 9, an operating part 35B projects toward the vehicle exterior from a surface of the I/S lock lever 35 that faces the vehicle exterior.

As shown in FIGS. 5 and 6, the worm wheel 39 is rotatably (turnably) supported by (on) the third shaft 75R. As shown in FIG. 9, a cam section 39C configured to engage with the cam 35C of the I/S lock lever 35 is formed on a surface of the worm wheel 39 that faces the vehicle exterior. When the electric motor M1 is actuated in response to a locking operation or a unlocking operation requested by a remote control key (e.g., a remote keyless entry fob) or the like, the worm wheel 39 is driven by the electric motor M1 to rotate and turns (pivots) clockwise or counterclockwise. Due to the engagement of the cam section 39C and the cam 350, the worm wheel 39 causes the I/S lock lever 35 to pivot between the position shown in FIG. 5 and the position shown in FIG. 10.

As shown in FIGS. 5 and 6, the fourth shaft 75S is inserted through an elongated hole 40H that extends in the up-down direction, whereby the linearly moving lock lever 40 is supported by (on) the fourth shaft 75S so as to be linearly movable. The fourth shaft 75S has a substantial "C" shaped cross-section. The linearly moving lock lever 40 has a substantial "Y" shape that forks above the elongated hole 40B.

As shown in FIGS. 6 and 9, a linearly moving convex segment 40E projects toward the vehicle exterior from a part of the linearly moving lock lever 40 that branches rearward and upward. As shown in FIG. 1, a linear-movement guide groove 71E extends in the up-down direction at a location that is upward and rearward relative to the fourth shaft section 75S; the linear-movement guide groove 71E is formed as recess in the first base wall 71 of the first housing 70. The linearly moving convex segment 40B is guided by the linear-movement guide groove 71E, whereby the linearly moving lock lever 40 is capable of linearly moving in the up-down direction without inclining (tilting).

As shown in FIGS. 5 and 6, a concave recess 40B is formed in the lower end portion of the linearly moving lock lever 40. As shown in FIG. 5, the operating part 35B of the I/S lock lever 35 engages in the concave recess 40B.

Figure 10:
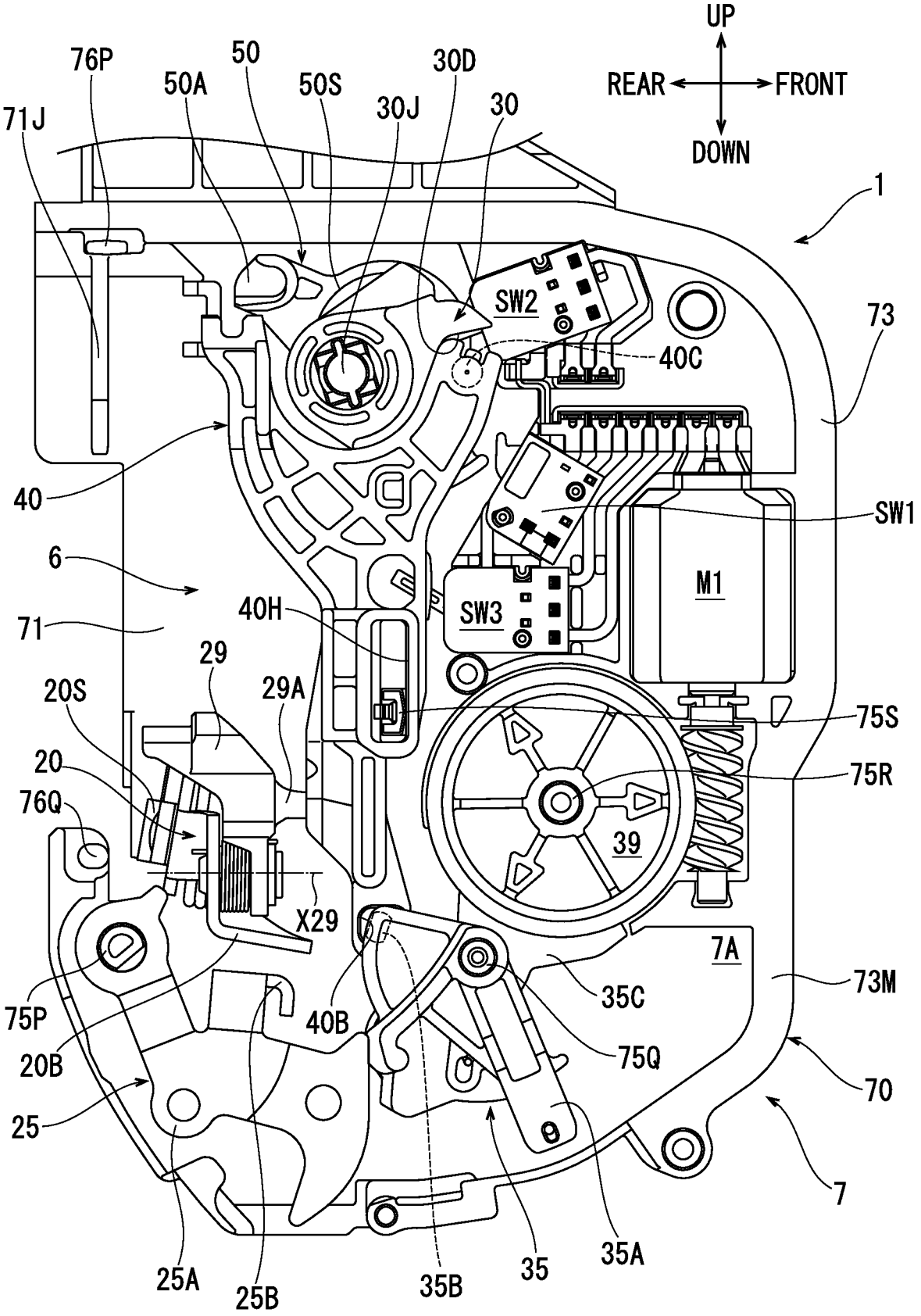
FIG. 10 is a front view of the first housing and the actuating mechanism.

As shown in FIG. 9, an engaging convex part 40C projects toward the vehicle exterior at (from) the distal end of a part of the linearly moving lock lever 40 that branches forward and upward. As shown in FIGS. 5, 10, and 16, the engaging convex part 40C projects into the engaging concave segment 30D of the O/S lock lever 30.

When the I/S lock lever 33 pivots from the position shown in FIG. 5 to the position shown in FIG. 10 in response to a locking operation performed on the interior door lock knob H3 or a locking operation requested by the remote control key or the like, the displacement of the I/S lock lever 35 is transmitted to the linearly moving lock lever 40 via the concave recess 40B and the operating part 35B. As a result thereof, the linearly moving lock lever 40 is pushed up from the position shown in FIG. 5, to the position shown in FIG. 10.

When the I/S lock lever 35 pivots from the position shown in FIG. 10 to the position shown in FIG. 5 in response to an unlocking operation performed on the interior door lock knob H3 or a unlocking operation requested by the remote control key or the like, the displacement of the I/S lock lever 35 is transmitted to the linearly moving lock lever 40 via the concave recess 40B and the operating part 35B. As a result thereof, the linearly moving lock lever 40 is pulled down from the position shown in FIG. 10 to the position shown in FIG. 5.

When the O/S lock lever 30 pivots from the position shown in FIGS. 5 and 10 to the position indicated by the solid line in FIG. 16 in response to the locking operation performed on the key cylinder H2, the displacement of the O/S lock lever 30 is transmitted to the linearly moving lock lever 40 via the engaging concave segment 30D and the engaging convex part 40C. As a result thereof, the linearly moving lock lever 40 is pulled up from the position shown in FIG. 5 to the position shown in FIG. 10.

When the O/S lock lever 30 pivots from the position indicated by the solid line in FIG. 16 to the position shown in FIGS. 5 and 10 in response to the unlocking operation performed on the key cylinder H2, the displacement of the O/S lock lever 30 is transmitted to the linearly moving lock lever 40 via the engaging concave segment 30D and the engaging convex part 40C. As a result thereof, the linearly moving lock lever 40 is pushed down from position shown in FIG. 10 to the position shown in FIG. 5.

As shown in FIGS. 9 and 11-14, a first surface 44A, a second surface 44B, and a third surface 44C are formed on the linearly moving lock lever 40 between the elongated hole 40H and the concave recess 40B. The first surface 44A, the second surface 44B, and the third surface 44C are formed on a surface of the linearly moving lock lever 40 that faces the vehicle exterior. The first surface 44A and the third surface 44C are each flat surfaces that extend in the up-down direction. The first surface 44A is displaced more towards the vehicle interior than the third surface 44C. The second surface 44B is an inclined surface that connects the lower end of the first surface 44A with the upper end of the third surface 44C.

As shown in FIGS. 5, 6, and 11-14, a projection 29A projects forward from the front surface of the inertial lever 29. The projection 29A comes into slide-contact with the first surface 44A, the second surface 44B, and the third surface 44C in response to the linear movement of the linearly moving lock lever 40.

As shown in FIGS. 3 and 11-14, an inertial lever guide surface 90G is formed on the third housing 90 on the side of the housing chamber 7A. The inertial lever guide surface 90G is a downward flat surface located farther towards the vehicle exterior than the contacted portion 12B of the pawl 12. The inertial lever guide surface 90G extends toward the vehicle exterior so as to separate (be spaced) from the contacted portion 12B. As shown in FIG. 11, when the O/S open lever 20 has not yet been pivoted, the inertial lever guide surface 90G is located between the lower end of the contacted portion 12B and the upper end of the inertial lever 29 in the up-down direction.

The position of the linearly moving lock lever 40 shown in FIGS. 11 and 12 is the same as the position of the linearly moving lock lever 40 shown in FIG. 5. The position of the linearly moving lock lever 40 shown in FIGS. 13 and 14 is the same as the position of the linearly moving lock lever 40 shown in FIG. 10.

When the linearly moving lock lever 40 is located at the position shown in FIGS. 11 and 12, the projection 29A of the inertial lever 29 comes into contact with the first surface 44A of the linearly moving lock lever 40, whereby the inertial level 29 is retained in an upward position. In the state shown in FIG. 12, if the inertial lever 29 rises, the inertial lever 29 comes into contact with the contacted portion 12B and causes the pawl 12 to open the fork 11 so that the striker S1 can be released.

Figure 13:
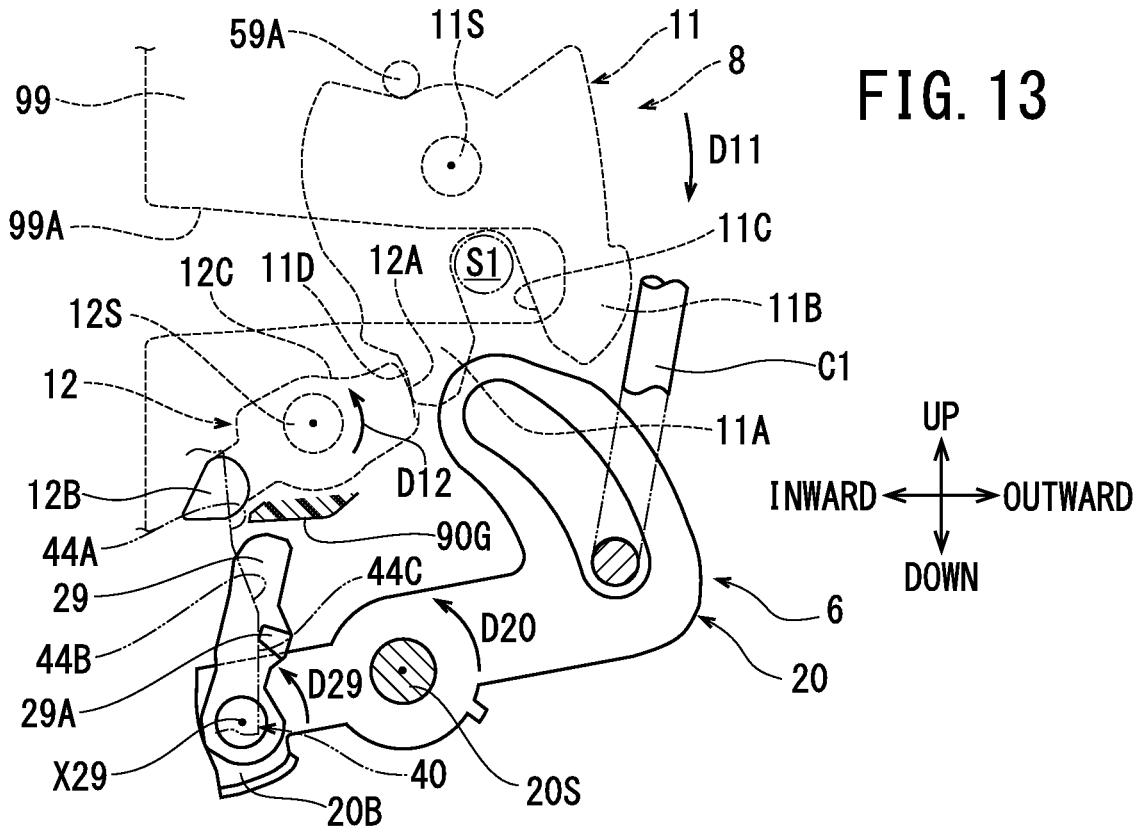
FIG. 13 is a third schematic view for explaining the operation of the O/S open lever, the inertial lever, the fork, and the pawl.
Figure 14:
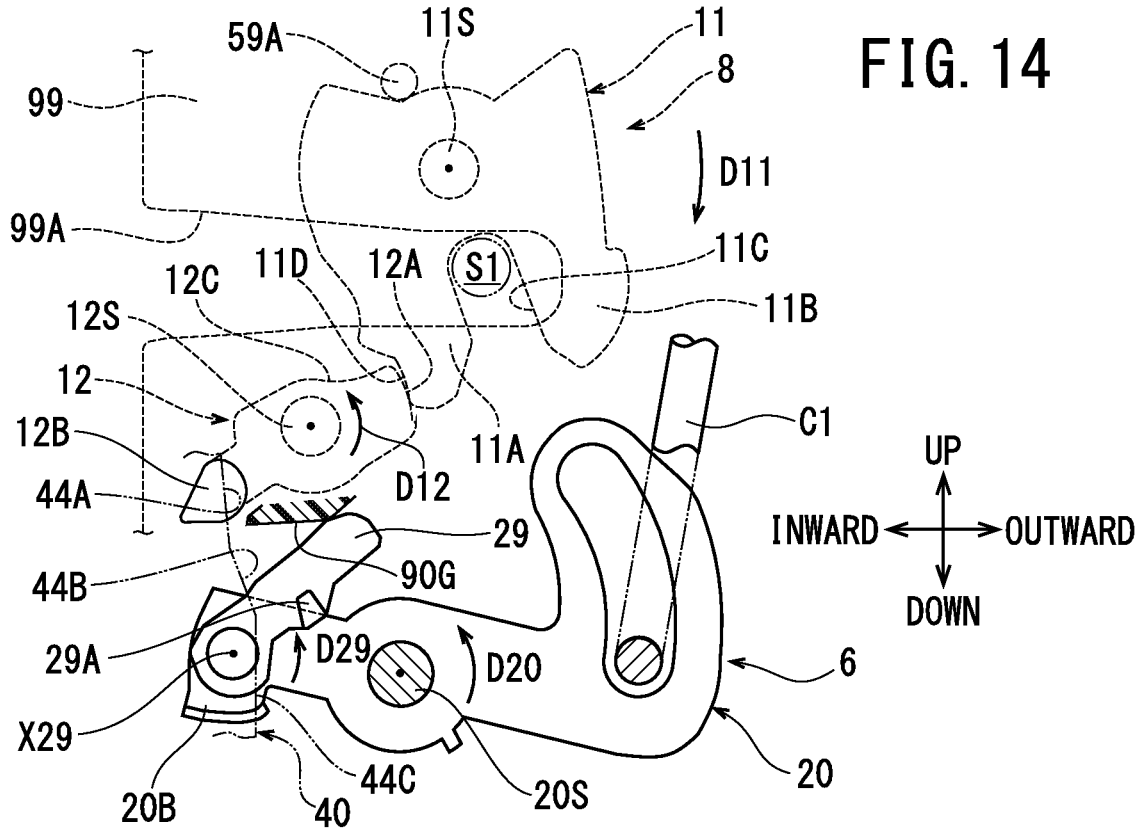
FIG. 14 is a fourth schematic view for explaining the operation of the O/S open lever, the inertial lever, the fork, and the pawl.

When the linearly moving lock lever 40 is displaced to the position shown in FIGS. 10, 13, and 14, the projection 29A of the inertial lever 29 comes into slide-contact with the second surface 44B of the linearly moving lock lever 40 and then comes into contact with the third surface 44C, whereby the inertial lever 29 is held inclined toward the vehicle exterior. In the state shown in FIG. 14, if the inertial lever 29 rises, the inertial lever 29 comes into contact with the inertial lever guide surface 90G, the inertial lever 29 separates from the contacted portion 12B, and the pawl 12 continues to fix (retain) the fork 11.

The position of the inertial lever 29 shown in FIGS. 11 and 12 is an unlock position where the inertial lever 29 is capable of acting on the pawl 12. The position of the inertial lever 29 shown in FIGS. 13 and 14 is a lock position where the inertial lever 29 is incapable of acting on the pawl 12. In the position shown in FIGS. 10, 13, and 14, the third surface 44C comes into contact with the projection 29A and the linearly moving lock lever 40 retains the inertial lever 29 in the lock position. The position of the linearly moving lock lever 40 shown in FIGS. 10, 13, and 14 is a locked position.

In the position shown in FIGS. 5, 11, and 12, the third surface 44C separates (is spaced) from the projection 29A and the linearly moving lock lever 40 does not hold the inertial lever 29 in the lock position shown in FIGS. 13 and 14. The inertial lever 20 brings the projection 29A into contact with the first surface 44A due to the urging force of the torsion coil spring 29T. When an impact (shock or impulse) acts on the inertial lever 29 (e.g., due to a vehicle side collision), the inertial lever 29 causes the projection 29A to separate from the first surface 44A and displace to the lock position. The position of the linearly moving lock lever 40 shown in FIGS. 5, 11, and 12 is an unlocked position.

In the unlocked position shown in FIGS. 5, 11, and 12, the linearly moving lock lever 40 causes the inertial lever 29 to stand upright and enables the fork 11 located in the latch position shown in FIG. 11 to be displaced to the unlatch position shown in FIG. 12. In the locked position shown in FIGS. 10, 13, and 14, the linearly moving lock lever 40 inclines the inertial lever 29 and disables (prevents) the fork 11 located in the latch position shown in FIG. 11 from being displaced to the unlatch position shown in FIG. 12.

When the linearly moving lock lever 40 is displaced to the unlocked position as shown in FIG. 5, the linearly moving lock lever 40 turns ON one of the contacts in the switch SW3. When the linearly moving lock lever 40 is displaced to the locked position as shown in FIG. 10, the linearly moving lock lever 40 turns ON another contact in the switch SW3. ON/OFF signals of the two contacts in the switch SW3 are used to control the locking and unlocking of the door and to determine the state of the door lock apparatus 1.

The above-described representative door lock apparatus 1, which has such a configuration, can hold the door closed with respect to the vehicle frame, open the door, and lock or unlock the door in the closed state in response to different types of operations performed by an occupant of the vehicle.

Operation and Effects

As shown in FIG. 18, the door lock apparatus 1 of the above-described embodiment includes the respective distal ends 75B of the first shaft 75P, the second shaft 75Q, the third shaft 75R, and the fourth shaft 75S formed in the first base wall 71 of the first housing 70 that are respectively welded, e.g., by laser transmission welding, to the corresponding contact parts 85A of the first shaft receptacle 85P, the second shaft receptacle 85Q, the third shaft receptacle 85R, and the fourth shaft receptacle 85S formed in the second base wall 81 of the second housing 80. That is, during assembly, it is only necessary to direct a laser beam towards a welded part of each of the distal ends 75B and the contact parts 85A to heat the welded parts. Therefore, as compared to fastening with screws, the assembly of the vehicle door lock apparatus can be simplified in this respect.

In addition, as shown in FIG. 19, the door lock apparatus 1 of the above-described embodiment includes the intermediate segments 76C of the supports 76P and 76Q that are formed in (on) the first housing 70 and are respectively inserted through the insertion-through holes 96P and 96Q formed in the third housing 90 to assemble (mount) the second housing 80 onto the first housing 70. Consequently, the slip-off preventing parts 86P and 86Q formed in the second housing 80 respectively align with the distal ends 76B of the supports 76P and 76Q to prevent the distal ends 76B from slipping off. That is, in the above-described door lock apparatus 1, when the third housing 90 is assembled (mounted) onto the first and second housings 70 and 80, it is not necessary to fasten these housings 70, 80, 90 using screws.

Therefore, in the above-described door lock apparatus 1, it is possible to simplify the work during assembly.

Furthermore, as shown in FIG. 17, when the first base wall 71 of the first housing 70 opposes the second base wall 31 of the second housing 80, and the first welded section 73M of the first peripheral edge section 73 of the first housing 70 is welded to the second welded section 83M of the second peripheral edge section 83 of the second housing 80 by laser transmission welding, the housing chamber 7A is formed. Because the process for welding the respective distal ends 75B of the first shaft 75P, the second shaft 75Q, the third shaft 75R, and the fourth shaft 75S formed in (on) the first base wall 71 of the first housing 70 to the corresponding contact parts 85A of the first shaft receptacle 85P, the second shaft receptacle 85Q, the third shaft receptacle 85R, and the fourth shaft receptacle 85S formed in the second base wall 81 of the second housing 80 is simultaneously performed with the laser transmission welding process, it is possible to further simplify the work during assembly. In addition, by welding of the first peripheral edge section 73 to the second peripheral edge section 83, it is possible to prevent the ingress of water or other foreign matter into the housing chamber 7A even if a seal or gasket is not disposed between the first peripheral edge section 73 and the second peripheral edge section 83. As a result, the design of the above-described door lock apparatus 1 prevents malfunctions of the electric motor M1 and the switches SW1 to SW3 caused by foreign matter.

Further, as shewn in FIG. 19, the door lock apparatus 1 includes the intermediate segments 76C of the supports 76P and 76Q formed in (on) the first housing 70 that are respectively inserted through the insertion-through holes 96P and 96Q formed in the third housing 90 to assemble (mount) the second housing 80 onto the first housing 70. Consequently, the slip-off preventing parts 86P and 86Q formed in the second housing 80 respectively align with the distal ends 76B of the supports 76P and 76Q to prevent the distal ends 76B from slipping off. That is, when the third housing 90 is assembled (mounted) onto the first and second housings 70 and 80, fastening with screws is unnecessary. In addition, the respective distal ends 75B of the first shaft 75P, the second shaft 75Q, the third shaft 75R, and the fourth shaft 75S are laser welded to the corresponding contact parts 85A of the first shaft receptacle 85P, the second shaft receptacle 85Q, the third shaft receptacle 85R, and the fourth shaft receptacle 85S at the same time that the distal ends 76B of the supports 76P and 76Q are laser welded to the corresponding slip-off preventing parts 86P and 86Q. As a result, the design of the above-described door lock apparatus 1 further simplifies the work during assembly.

In the above-described door lock apparatus the first housing 70 is formed by (of) a light absorptive resin material. On the other hand, the second housing 80 is formed by (of) a light transmissive resin material. Consequently, as shown in FIGS. 7, 8, and 17, when the third housing 90 is assembled (mounted) onto the first and second housings 70 and 80, the first peripheral edge section 73 of the first housing 70 can be joined (welded) to the second peripheral edge section 83 of the second housing 80 by the laser transmission welding (laser plastic welding) by directing the laser beam to irradiate through the light transmissive resin material and contact the light absorptive resin material, thereby heating and melting both. As shown in FIG. 19, the distal ends 76B of the supports 76P and 76Q of the first housing 70 can also be respectively welded to the slip-off preventing parts 86P and 86Q of the second housing 80 by the laser transmission welding. As a result, the design of the above-described door lock apparatus 1 further simplifies the work during assembly while still firmly joining the third housing 90 with the first and second housings 70 and 80.

In the above-described door lock apparatus 1, laser transmission welding was utilized. Therefore, as compared with ultrasonic welding, it is possible to achieve more precise and highly flexible welding.

Further, as shown in FIG. 18, the door lock apparatus 1 includes the spacing setting surfaces 75W and 85W provided on the distal end 75B and the contact part 85A that contact each other without being melted/fused and set (determine) the spacing W1 between the first base wall 71 of the first housing 70 and the second base wall 81 of the second housing 80. Therefore, as compared with ultrasonic welding in which frictional heat occurs along the entire range of contact, it is possible to more accurately set the spacing W1. As a result, the I/S open lever 25, the I/S lock lever 35, the linearly moving lock lever 40, and the worm wheel 39 can rotate (turn) or move linearly more smoothly while being respectively supported by (on) the first shaft 75P, the second shaft 75Q, the third shaft 75R, and the fourth shaft 75S.

In the above-described door lock apparatus 1, as shown in FIG. 18, the respective fitting parts 85B of the first shaft receptacle 85P, the second shaft receptacle 85Q, the third shaft receptacle 85R, and the fourth shaft receptacle 85S respectively fit with the corresponding distal ends 75B of the first shaft 75P, the second shaft 75Q, the third shaft 7SR, and the fourth shaft 75S. Therefore, it is possible to accurately position the distal ends 75B during the mounting (assembly). As a result, the I/S open lever 25, the I/S lock lever 35, the linearly moving lock lever 40, and the worm wheel 39 can rotate (turn) or move linearly more smoothly while feeing respectively supported by (on) the first shaft 75P, the second shaft 75Q, the third shaft 75R, and the fourth shaft 75S.

Further, in the above-described door lock apparatus 1, the first housing 70, the second housing 80, and the third housing 90 are assembled without using screws, which further simplifies the work during assembly and leads to a reduction in manufacturing costs.

In the above-described door lock apparatus 1, when the third housing 90 is assembled (mounted) onto the first and second housings 70 and 80, the fitting groove 24 in the distal end of the O/S open lever pivot shaft 20S formed in the first housing 70 (shown in FIG. 7) fits with the fitting plate 94L of the shaft receptacle 94 formed in the third housing 90 (shown in FIG. 3). Consequently, it is possible to fix the O/S open lever pivot shaft 20S while preventing the O/S open lever 20, which is supported by (on) the O/S open lever pivot shaft 20S, from slipping off. As a result, the design of the door lock apparatus 1 further simplifies the work during assembly.

In the above-described door lock apparatus 1, the guide 71J formed in the first base wall 71 of the first housing 70 (e.g., as shown, in FIG. 7) guides the rib 90J formed on the third housing 90 (as shown in FIG. 4). Consequently, it is possible to easily carry out the work to insert the supports 76P and 76Q of the first housing 70 through the insertion-through holes 96P and 96Q of the third housing 90.

Modification—Second Embodiment

Figure 20:
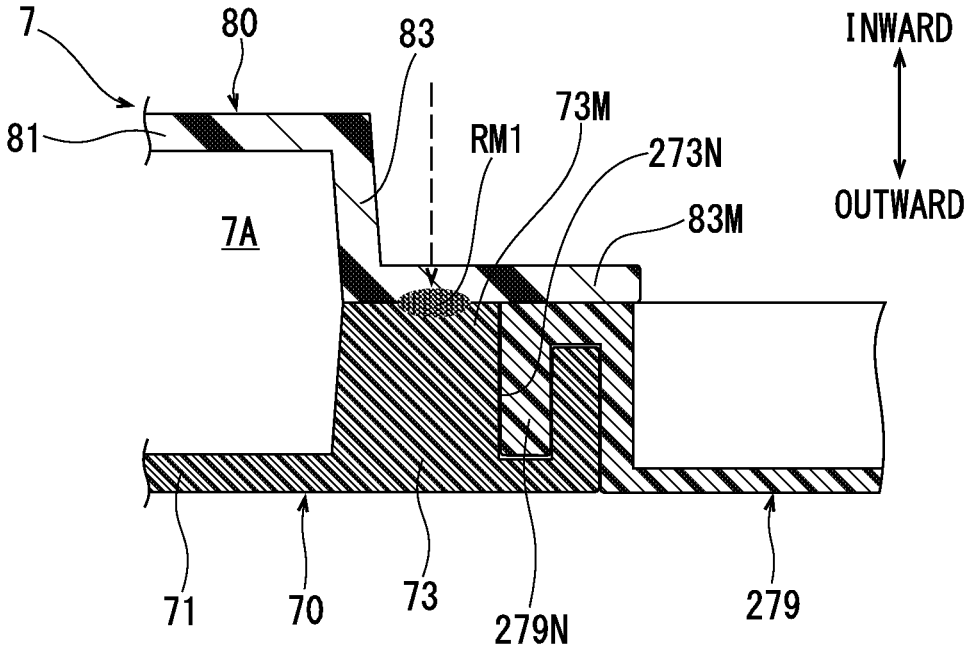
FIG. 20 is a schematic sectional view relating to a vehicle door lock apparatus of a second embodiment of the present teachings and showing another part fit with the first peripheral edge section of the first housing, the first peripheral edge section being welded to the second peripheral edge section of the second housing by laser transmission welding.

In the first housing 70 according to the first embodiment as shown in FIG. 7, the part that retains the key-cylinder retainer C2A above the first peripheral edge section 73 is integrally formed. However, as shown, in FIG. 20, this part may be formed as a separate part 279. In this modification of the present teachings (second embodiment), a joining convex segment 279N projects toward the vehicle exterior and is formed in a base section of the separate part 279. In the first peripheral edge section 73, a joining concave segment 273N is formed so as to recess toward the vehicle exterior. After the joining convex segment 279N is fit in the joining concave segment 273N, the second welded section 83M of the second peripheral edge section 83 of the second housing 80 is brought into contact with the periphery of the joining convex segment 279N in the separate part 279 from the vehicle interior. Thereafter, the first welded section 73M is welded to the second welded section 83M by laser transmission welding, whereby the first housing 70 is joined to the second housing 80 with the separate part 279 held between the first peripheral edge section 73 and the second peripheral edge section 83.

Such a modified door lock apparatus 1 also makes possible a simplification of the work during assembly. By preparing a plurality of parts having different shapes as the separate part 279, it is possible to easily carry out a modification of the type of the door lock apparatus 1 that is constructed according to the present teachings, e.g., to adapt the door lock apparatus 1 to different applications of the present teachings.

Although the present invention has been described above in line with the first embodiment and the modification thereto, it is needless to say that the invention is not limited to the above-described embodiment and modification, but may be appropriately modified in application without departing from the spirit or gist of the invention.

For example, in the above-described embodiments, the welding is performed by laser transmission welding. However, the present invention is not limited to this type of welding and other types of welding may be utilized, such as heating plate welding, ultrasonic welding, or the like, in certain aspects of the present teachings.

In the above-described embodiments, the projections are the first to fourth shaft 75P, 75Q, 75R, and 75S that respectively support the I/S open lever 25, the I/S lock lever 35, the worm wheel 39, and the linearly moving lock lever 40 so as to be rotatable (turnable) or linearly movable. However, the present invention is not limited to such a configuration. For example, one or more of the projections may be omitted or may be a simple column or the like.

In the above-described embodiments, the pair of the first shaft 75P and the first shaft receptacle 85P, the pair of the second shaft 75Q and the second shaft receptacle 85Q, the pair of the third shaft 75R and the third shaft receptacle 85R, and the pair of the fourth shaft 75S and the fourth shaft receptacle 85S are all welded. However, the present invention is not limited to such a configuration and instead welding may be performed at (on) at least one of such pairs, but less than all of the pairs.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved vehicle door lock apparatuses and methods for manufacturing and operating the same.

Moreover, combinations of features and steps disclosed in the above detail description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

The invention claimed is:

1. A vehicle door lock apparatus comprising:

a latch housing having a latch chamber defined in an interior of the latch housing;

a latch mechanism housed in the latch chamber and configured to hold a door closed with respect to a vehicle frame;

an actuating housing assembled onto the latch housing, a housing chamber being formed in an interior of the actuating housing; and an actuating mechanism housed in the housing chamber and configured to actuate the latch mechanism, wherein:

the actuating housing includes a first housing made of resin joined to a second housing made of resin to form the housing chamber, the first housing includes at least one projection having a proximal end and a distal end, the at least one projection extending toward the second housing in a direction from the proximal end to the distal end, the second housing includes at least one receptacle having a fitting part that at least partially surrounds and positions the distal end of the projection and a contact part abutted on and fixedly welded to the distal end of the at least one projection, and the actuating mechanism includes an actuating member supported by the at least one projection so as to be pivotable, rotatable, turnable, or linearly movable on the at least one projection.

2. The vehicle door lock apparatus according to claim 1, wherein the at least one projection extends through the actuating member.

3. The vehicle door lock apparatus according to claim 1, wherein:

the latch housing includes (i) a base plate made of metal and configured to be affixed to a door of a vehicle and (ii) a third housing made of resin assembled onto the base plate and forming the latch chamber, together with the base plate, in an interior of the third housing and the base plate, the first housing includes at least two supports, each having a proximal end and a distal end and extending toward the second housing in a direction from the proximal end to the distal end via an intermediate segment, insertion-through holes are formed in the third housing, the intermediate segments of the supports are respectively inserted in the insertion-through holes, and the second housing includes slip-off preventing parts respectively aligned with the distal ends of the supports.

4. The vehicle door lock apparatus according to claim 1, wherein:

one of the first housing and the second housing is formed by a light absorptive material, and the other of the first housing and the second housing is formed by a light transmissive material.

5. The vehicle door lock apparatus according to claim 4, wherein the distal end of the at least one projection and the contact part each have a spacing setting surface, the spacing setting surfaces are in contact with each other without being melted or fused together and the spacing setting surfaces set a spacing between the first housing and the second housing.

6. The vehicle door lock apparatus according to claim 1, wherein the fitting part surrounds the contact part and fits with the distal end of the at least one projection.

7. The vehicle door lock apparatus according to claim 1, wherein the latch mechanism includes:

a fork that is pivotable in the latch housing and is movable between a latch position for holding a striker and an unlatch position for releasing the striker; and a pawl that is pivotable in the latch housing to fix or open the fork.

8. The vehicle door lock apparatus according to claim 7, wherein:

the at least one projection includes a first shaft and a second shaft, the at least one receptacle includes a first shaft receptacle that surrounds and is welded to a distal end of the first shaft and a second shaft receptacle that surrounds and is welded to a distal end of the second shaft, the actuating member includes:

a first lever configured to act on the pawl by being displaced and to cause the pawl to open the fork;

a second lever pivotably supported by the first shaft, operably coupled to a door handle at a first end, and configured to pivot in response to an opening operation performed on the door handle so as to act on the first lever and displace the first lever; and a third lever pivotably supported by the second shaft, operably coupled to a lock operator at a first end, and configured to pivot in response to a locking operation or an unlocking operation performed on the lock operator to act on the first lever and displace the first lever to an unlock position, where the first lever is capable of acting on the pawl, and to a lock position, where the first lever is incapable of acting on the pawl, and the first shaft extends through the second lever and the second shaft extends through the third lever.

9. The vehicle door lock apparatus according to claim 8, wherein:

the at least one projection further includes a third shaft and a fourth shaft, the at least one receptacle further includes a third shaft receptacle that surrounds and is welded to a distal end of the third shaft and a fourth shaft receptacle that surrounds and is welded to a distal end of the fourth shaft, an electric motor is housed in the housing chamber, the actuating member further includes:

a worm wheel rotatably supported by the third shaft, configured to be rotated by the electric motor to cause the third lever to pivot, and configured to switch the first lever from the unlock position to the lock position and vice versa, and a fourth lever supported by the fourth shaft so as to be linearly movable, configured to be displaced to a locked position, where the first lever is retained in the lock position, and to an unlocked position, where the first lever is not retained in the lock position, and, in the unlocked position, configured to enable the fork, when in the latch position, to be displaced to the unlatch position and, in the locked position, to disable or prevent the fork, when in the latch position, from being displaced to the unlatch position, the third lever is configured to displace the fourth lever from the unlocked position to the locked position in response to the locking operation and to displace the fourth lever from the locked position to the unlocked position in response to the unlocking operation, and the third shaft extends through the worm wheel and the fourth shaft extends through the fourth lever.

10. The vehicle door lock apparatus according to claim 1, further comprising:

an electronic component housed in the housing chamber, wherein:

the first housing includes a first peripheral edge section surrounding a first base wall, the second housing includes a second peripheral edge section surrounding a second base wall, and the housing chamber is formed by plastic welding the first peripheral edge section to the second peripheral edge section with the first base wall disposed so as to oppose the second base wall.

11. A vehicle comprising:

a vehicle frame, a door pivotably coupled to the vehicle frame, the vehicle door lock apparatus according to claim 2 fixed to the door, and a striker fixed to the vehicle frame, wherein:

an entry opening is formed in the latch housing and is configured to receive the striker, the latch mechanism includes:

a fork that is pivotable in the latch housing and is movable between a latch position that holds the striker in the entry opening and an unlatch position that permits the striker to be removed from the entry opening; and a pawl that is pivotable in the latch housing to fix or open the fork, the at least one projection includes a first shaft and a second shaft, the at least one receptacle includes a first shaft receptacle that surrounds and is welded to a distal end of the first shaft and a second shaft receptacle that surrounds and is welded to a distal end of the second shaft, and the actuating member includes:

a first lever configured to act on the pawl by being displaced and to cause the pawl to open the fork;

a second lever pivotably supported by the first shaft, operably coupled to a door handle at a first end, and configured to pivot in response to an opening operation performed on the door handle so as to act on the first lever and displace the first lever; and a third lever pivotably supported by the second shaft, operably coupled to a lock operator at a first end, and configured to pivot in response to a locking operation or an unlocking operation performed on the lock operator to act on the first lever and displace the first lever to an unlock position, where the first lever is capable of acting on the pawl, and to a lock position, where the first lever is incapable of acting on the pawl.

12. The vehicle according to claim 11, further comprising an electronic component housed in the housing chamber, wherein:

the first housing includes a first peripheral edge section surrounding a first base wall, the second housing includes a second peripheral edge section surrounding a second base wall, and the housing chamber is formed by welding the first peripheral edge section to the second peripheral edge section with the first base wall disposed so as to oppose the second base wall.

13. The vehicle according to claim 12, wherein:

the at least one projection further includes a third shaft, the at least one receptacle further includes a third shaft receptacle that surrounds and is welded to a distal end of the third shaft, the electronic component of the actuating mechanism includes an electric motor, and the actuating member further includes a worm wheel rotatably supported by the third shaft, configured to be rotated by the electric motor to cause the third lever to pivot, and configured to switch the first lever from the unlock position to the lock position and vice versa.

14. The vehicle according to claim 13, wherein:

the at least one projection further includes a fourth shaft, the at least one receptacle further includes a fourth shaft receptacle that surrounds and is welded to a distal end of the fourth shaft, the actuating member further includes a fourth lever supported by the fourth shaft so as to be linearly movable, configured to be displaced to a locked position, where the first lever is retained in the lock position, and to an unlocked position, where the first lever is not retained in the lock position, and, in the unlocked position, configured to enable the fork, when in the latch position, to be displaced to the unlatch position and, in the locked position, to disable or prevent the fork, when in the latch position, from being displaced to the unlatch position, and the third lever is configured to displace the fourth lever from the unlocked position to the locked position in response to the locking operation and to displace the fourth lever from the locked position to the unlocked position in response to the unlocking operation.

15. The vehicle according to claim 14, wherein:

the latch housing includes (i) a base plate made of metal and affixed to the door and (ii) a third housing made of resin assembled onto the base plate and forming the latch chamber, together with the base plate, in an interior of the third housing and the base plate, the first housing includes at least two supports, each having a proximal end and a distal end and extending toward the second housing in a direction from the proximal end to the distal end via an intermediate segment, insertion-through holes are formed in the third housing, the intermediate segments of the supports are respectively inserted in the insertion-through holes, and the second housing includes slip-off preventing parts respectively aligned with the distal ends of the supports.

16. The vehicle according to claim 15, wherein:

one of the first housing and the second housing is formed by a light absorptive material, and the other of the first housing and the second housing is formed by a light transmissive material.

17. The vehicle according to claim 16, wherein the distal end of the at least one projection and the contact part each have a spacing setting surface, the spacing setting surfaces are in contact with each other without being melted or fused together and the spacing setting surfaces set a spacing between the first housing and the second housing.

18. The vehicle according to claim 17, wherein the fitting part surrounds the contact part and fits with the distal end of the at least one projection.

19. A vehicle door lock apparatus, comprising:

a latch housing having a latch chamber defined in an interior of the latch housing;

a fork and a pawl housed in the latch chamber and configured such that the fork releaseably engages a striker affixed to a vehicle frame so as to hold a vehicle door closed with respect to the vehicle frame;

an actuating housing mounted on the latch housing, a housing chamber being formed in an interior of the actuating housing; and an actuator housed in the housing chamber and configured to actuate the fork and a pawl;

wherein:

the actuating housing includes a first housing made of resin fused to a second housing made of resin to form the housing chamber, the first housing includes at least one projection that extends from a proximal end to a distal end connected to the second housing, the second housing includes at least one blind hole that holds and surrounds the distal end of the projection, and a contact part inside the at least one blind hole is materially fused and thus fixedly attached to the distal end of the at least one projection.

20. The vehicle door lock apparatus according to claim 19, wherein:

one of the first housing and the second housing is formed of a light absorptive material, the other of the first housing and the second housing is formed of a light transmissive material, the first housing includes a first peripheral edge section entirely surrounding a first base wall, the second housing includes a second peripheral edge section entirely surrounding a second base wall, and the first peripheral edge section is fused to the second peripheral edge section so as to hermetically seal the first housing with respect to the second housing.

* * * * *